US008646867B2

(12) United States Patent
Komatsu

(10) Patent No.: US 8,646,867 B2
(45) Date of Patent: Feb. 11, 2014

(54) LIQUID-DISCHARGING DEVICE, INSPECTION METHOD OF LIQUID-DISCHARGING DEVICE, AND PROGRAM

(75) Inventor: Shinya Komatsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 13/304,996

(22) Filed: Nov. 28, 2011

(65) Prior Publication Data

US 2012/0133700 A1 May 31, 2012

(30) Foreign Application Priority Data

Nov. 29, 2010 (JP) ..... 2010-264602

(51) Int. Cl.
*B41J 29/393* (2006.01)

(52) U.S. Cl.
USPC ..... 347/19; 14/23

(58) Field of Classification Search
USPC ..... 347/5, 9, 12, 14, 19, 23, 40, 44, 47
See application file for complete search history.

(56) References Cited

U.S. PATENT DOCUMENTS 7,192,112 B2 * 3/2007 Nakanishi et al. ..... 347/19
7,300,131 B2 * 11/2007 Sakagami et al. ..... 347/19
2010/0060690 A1 3/2010 Hosokawa et al.

FOREIGN PATENT DOCUMENTS

JP 2010-064309 A 3/2010

* cited by examiner

*Primary Examiner* — Juanita D Jackson
(74) *Attorney, Agent, or Firm* — Global IP Counselors, LLP

(57) ABSTRACT

A first discharge inspection part is configured to inspect and judge a first target nozzle regarding whether or not the first target nozzle discharges the liquid, and is configured to again inspect the first target nozzle if noise is detected. A second discharge inspection part is configured to inspect and judge a second target nozzle regarding whether or not the second target nozzle discharges the liquid, and is configured to again inspect the second target nozzle if noise is detected. The first discharge inspection part and the second discharge inspection part inspect the first target nozzle and the second target nozzle in parallel. The first target nozzle and the second target nozzle shift, if the first target nozzle has been judged, regardless of or not the noise is detected during the first target nozzle being again inspected.

8 Claims, 25 Drawing Sheets

REFERENCE EXAMPLE

| Discharge Inspection Parts | Number of Unit Block | | | | | | | | | | | Final Judgment |
|---|---|---|---|---|---|---|---|---|---|---|---|---|
| | 1 | 2 | 3 | 4 | 5 | 6 | 7 | 8 | 9 | 10 | 11 | |
| (1) | O | O | O | ? | ? | ? | ? | ? | ? | ? | ? | O |
| (2) | ? | ? | ? | ? | ? | ? | ? | ? | ? | ? | O | O |
| (3) | O | O | O | X | X | ? | ? | ? | X | X | X | X |
| (4) | O | O | X | O | X | O | O | O | X | X | X | X |

O Regular Judgment
X Irregular Judgment
? Noise Judgment

Fig. 17

| Saving Parts | Number of Unit Block | | | | | | | | | | | Final Judgment |
|---|---|---|---|---|---|---|---|---|---|---|---|---|
| | 1 | 2 | 3 | 4 | 5 | 6 | 7 | 8 | 9 | 10 | 11 | |
| (1) | O | O | O | O | O | O | O | O | O | O | O | O |
| (2) | ? | ? | ? | ? | ? | ? | ? | ? | ? | ? | O | O |
| (3) | O | O | O | X | X | X | X | X | X | X | X | X |
| (4) | O | O | X | O | X | O | O | O | X | X | X | X |

O Regular Judgment
X Irregular Judgment
? Noise Judgment

Fig. 18

| Discharge Inspection Parts | Number of Unit Block | | | | | | | | | | | Final Judgment |
|---|---|---|---|---|---|---|---|---|---|---|---|---|
| | 1 | 2 | 3 | 4 | 5 | 6 | 7 | 8 | 9 | 10 | 11 | |
| (1) | O | O | O | ? | ? | ? | ? | ? | ? | ? | ? | O |
| (2) | ? | ? | ? | ? | ? | ? | ? | ? | ? | ? | O | O |
| (3) | O | O | O | X | X | ? | ? | ? | X | X | X | X |
| (4) | O | O | X | O | X | O | O | O | X | X | X | O |

O Regular Judgment
X Irregular Judgment
? Noise Judgment

Fig. 23

| Discharge Inspection Parts | Number of Unit Block | | | | | | | | | | | Final Judgment |
|---|---|---|---|---|---|---|---|---|---|---|---|---|
| | 1 | 2 | 3 | 4 | 5 | 6 | 7 | 8 | 9 | 10 | 11 | |
| (1) | O | O | O | ? | ? | ? | ? | ? | ? | ? | ? | Regular |
| (2) | ? | ? | ? | ? | ? | ? | ? | ? | ? | ? | O | Regular |
| (3) | O | O | O | X | X | ? | ? | ? | X | X | X | Irregular |
| (4) | O | O | X | O | X | O | O | O | X | X | X | Uncertain |

O Regular Judgment
X Irregular Judgment
? Noise Judgment

Fig. 25

LIQUID-DISCHARGING DEVICE, INSPECTION METHOD OF LIQUID-DISCHARGING DEVICE, AND PROGRAM

CROSS-REFERENCE TO RELATED APPLICATIONS

This application claims priority to Japanese Patent Application No. 2010-264602 filed on Nov. 29, 2010. The entire disclosure of Japanese Patent Application No. 2010-264602 is hereby incorporated herein by reference.

BACKGROUND

1. Technical Field

The present invention relates to a liquid-discharging device, an inspection method of a liquid-discharging device, and a computer program to perform the inspection.

2. Background Technology

Liquid-discharging devices are known to perform nozzle discharge inspection by causing electrically charged liquid droplets to be discharged from nozzles onto discharge inspection electrodes, and detect the electrical change in the electrodes. When discharge inspection is performed by detecting such electrical changes, noise occurring during the discharge inspection causes erroneous inspections.

In the discharge inspection method of Patent Citation 1, a non-discharge period is provided in which liquid droplets are not discharged during discharge inspection, and a judgment of whether or not noise has occurred during discharge inspection is made based on electrode potential changes during the non-discharge period.

Japanese Patent Application Publication No. 2010-64309 (Patent Citation 1) is examples of the related art.

SUMMARY

Problems to be Solved by the Invention

When the device has a plurality of heads, one idea is to provide a plurality of discharge inspection parts, and to process discharge inspections in the plurality of discharge inspection parts in parallel. When discharge inspections are processed in parallel, and when the occurrence of noise is detected in any of the discharge inspection parts and the nozzles that are inspection targets are inspected a second time, it is time-consuming to complete discharge inspection of all of the nozzles. Particularly, as the number of discharge inspection parts being processed in parallel increases, the probability of any of the discharge inspection parts detecting noise occurrence increases, and the time required for discharge inspection becomes much longer. In view of this, an object of the present invention is to shorten the time required for discharge inspection when a plurality of discharge inspections are processed in parallel.

Means Used to Solve the Above-Mentioned Problems

A liquid-discharge inspection device for a liquid-discharging device includes a first head, a second head, a first discharge inspection part, and a second discharge inspection part.

The first head has first and second nozzles being configured to discharge liquid. The second head has third and fourth nozzles being configured to discharge the liquid. The first discharge inspection part is configured to inspect and judge a first target nozzle regarding whether or not the first target nozzle discharges the liquid, and is configured to again inspect the first target nozzle if noise is detected during the first target nozzle being inspected. The first target nozzle shifts among the first nozzle and the second nozzle. The second discharge inspection part is configured to inspect and judge a second target nozzle regarding whether or not the second target nozzle discharges the liquid, and is configured to again inspect the second target nozzle if noise is detected during the second target nozzle being inspected. The second target nozzle shifts among the third nozzle and the fourth nozzle. The first target nozzle and the second target nozzle shifts in parallel. The first discharge inspection part and the second discharge inspection part inspect the first target nozzle and the second target nozzle in parallel. The first target nozzle and the second target nozzle shift, if the first target nozzle has been judged, regardless of or not the noise is detected during the first target nozzle being again inspected.

BRIEF DESCRIPTION OF THE DRAWINGS

Referring now to the attached drawings which form a part of this original disclosure:

FIG. 17 is an explanatory chart of judgment results of nozzle #1 of a matte black nozzle row;

FIG. 18 is an explanatory chart of judgment results saved to a saving part of the controller 10;

FIG. 23 is an explanatory chart of results of judgments obtained through the process of FIG. 22;

FIG. 25 is an explanatory chart of results of judgments obtained through the process of FIG. 24.

DETAILED DESCRIPTION OF EXEMPLARY EMBODIMENTS

Figure 1:
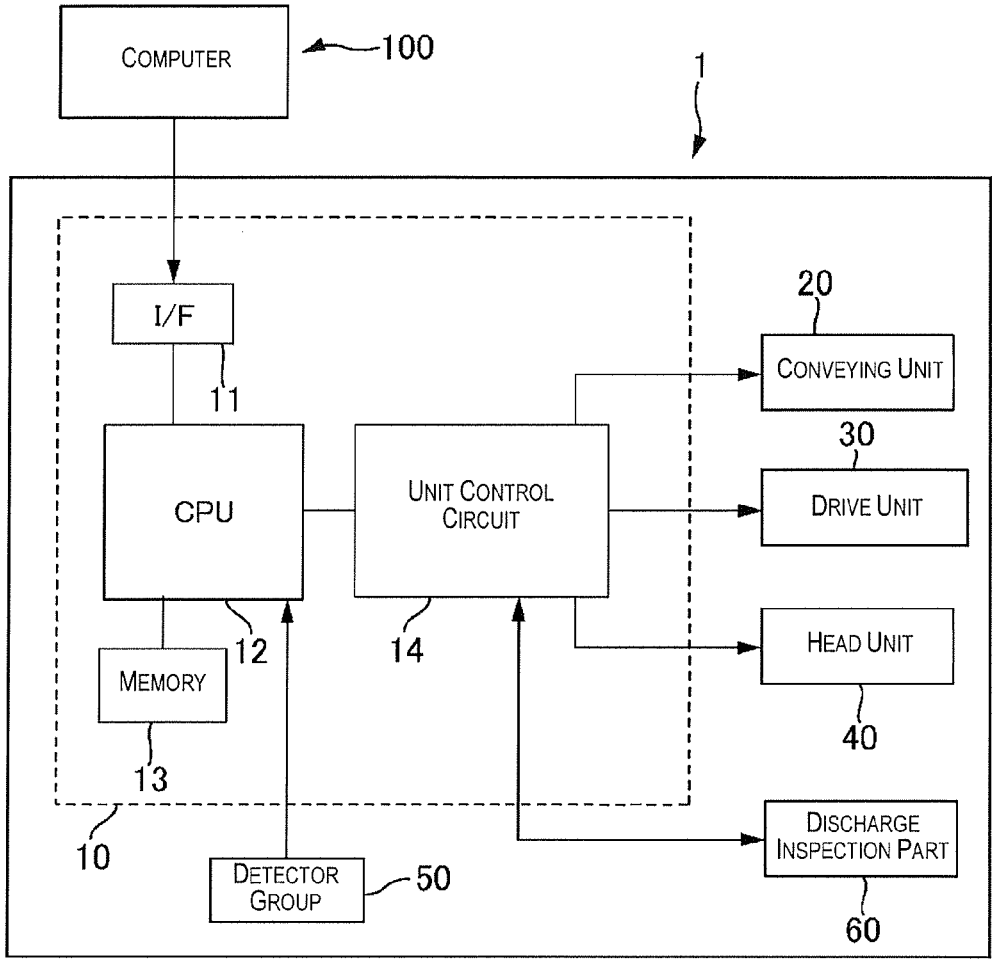
FIG. 1 is a structural block diagram of a printing system.

At least the following matters are made apparent by the present specification and the descriptions of the accompanying drawings.

A liquid-discharging device includes a plurality of heads individually having a plurality of nozzles for discharging a liquid and a plurality of discharge inspection parts provided correspondingly with respect to the heads wherein each of the discharge inspection parts judges whether or not the liquid has been discharged from the nozzles of the corresponding heads. When noise is detected during the inspection, each of the discharged inspection parts performs a re-inspection using the same nozzles as inspection targets. The re-inspection of the nozzles that are inspection targets and the shift of the nozzles that are inspection targets are processed in parallel in the plurality of discharge inspection parts. Even when the discharge inspection parts have detected the noise, the plurality of discharge inspection parts that have detected the noise shift the inspection target to the next nozzle if the discharge inspection parts have already judged whether or not the liquid has been discharged from the nozzles that are inspection targets. Accordingly, the time required for discharge inspection can be shortened even when a plurality of discharge inspections are processed in parallel.

Preferably, inspection of the nozzles that are inspection targets is performed based on the most recent judgment results of whether or not the liquid has been discharged from the nozzles that are inspection targets. It is thereby possible to perform discharge inspection conforming to the current state of the device. Only the most recent results need be kept, and the preceding judgment results need not be kept.

Preferably, when the plurality of discharge inspection parts re-inspect the nozzles that are inspection targets, a history is kept of the judgment results of each of the discharge inspection parts. And inspection of the nozzles that are inspection targets is performed based on the history. This arrangement makes it possible to shorten the time duration needed for discharge inspection.

Preferably, inspection of the nozzles is performed by using the number of the judgments of whether or not the liquid has been discharged, on the basis of the history. For instance, if the first nozzle fails the inspection more than passing the inspection, then another set of inspections will be performed. The probability of the inspection results being correct thereby increases.

Preferably, the stability of the discharge of liquid from the nozzles is inspected according to the percentage of judgments of whether or not the liquid has been discharged based on the history. It is thereby possible to perform other judgments apart from whether or not there is a discharge of liquid.

Preferably, the number of re-inspections is totaled, and notification of an error is made when the total value exceeds a predetermined number. It is thereby possible to avoid circumstances in which re-inspection is continually repeated.

A method for inspecting a liquid-discharging device includes a plurality of heads individually having a plurality of nozzles for discharging a liquid and a plurality of discharge inspection parts provided correspondingly with respect to the heads, wherein each of the discharge inspection parts judges whether or not the liquid has been discharged from the nozzles of the corresponding heads, and, when noise is detected during inspection, performs a re-inspection using the same nozzles as inspection targets. The re-inspection of the nozzles that are inspection targets and the shift of the nozzles that are inspection targets are processed in parallel in the plurality of discharge inspection parts. Even when the discharge inspection parts have detected the noise, the plurality of discharge inspection parts that have detected the noise shift the inspection target to the next nozzle if the discharge inspection parts have already judged whether or not the liquid has been discharged from the nozzles that are inspection targets. Accordingly, the time required for discharge inspection can be shortened even when a plurality of discharge inspections are processed in parallel.

A computer program is provided, wherein a liquid-discharging device includes a plurality of heads individually having a plurality of nozzles for discharging a liquid and a plurality of discharge inspection parts provided correspondingly with respect to the heads. Each of the discharge inspection parts judges whether or not the liquid has been discharged from the nozzles of the corresponding heads, and, when noise is detected during inspection, performs a re-inspection using the same nozzles as inspection targets. The computer program executes the functions of causing the re-inspection of the nozzles that are inspection targets and the shift of the nozzles that are inspection targets to be processed in parallel in the plurality of discharge inspection parts, and even when the discharge inspection parts have detected the noise, causing the plurality of discharge inspection parts that have detected the noise to shift the inspection target to the next nozzle if the discharge inspection parts have already judged whether or not the liquid has been discharged from the nozzles that are inspection targets. Accordingly, the time required for discharge inspection can be shortened even when a plurality of discharge inspections are processed in parallel.

First Embodiment

Overall Configuration

Hereinbelow is described an example of a printing system in which the liquid-discharging device is an inkjet printer (a printer hereinbelow), and the printer and a computer are connected.

Figure 2A:
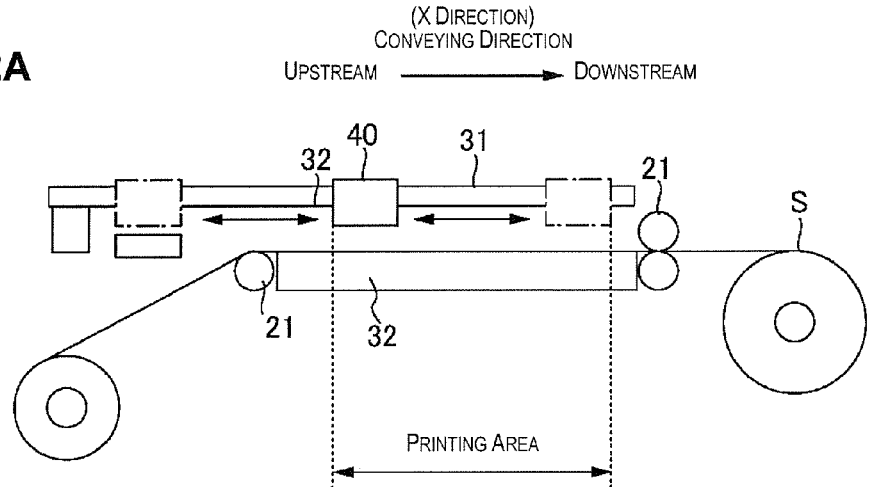
FIG. 2A is a schematic cross-sectional view of a printer 1.
Figure 2B:
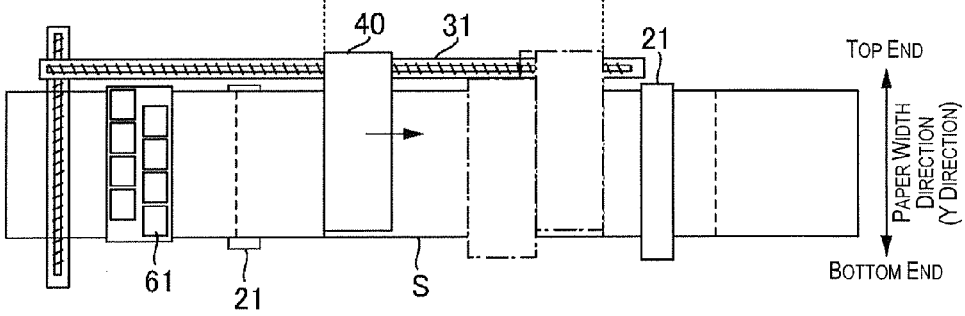
FIG. 2B is a schematic top view of the printer 1.

FIG. 1 is a structural block diagram of a printing system. FIG. 2A is a schematic cross-sectional view of a printer 1, and FIG. 2B is a schematic top view of the printer 1.

A computer 100 is communicably connected with the printer 1, and the computer 100 outputs to the printer 1 print data for causing the printer 1 to print an image. A computer program (a printer driver) is installed in the computer 100 for converting image data outputted from an application program to print data.

A controller 10 is a control unit for performing control of the printer 1. An interface 11 is used for performing the transmission of data between the computer 100 and the printer 1. A CPU 12 is a computing and processing device for performing control of the entire printer 1. A memory 13 is for ensuring areas for storing the programs of the CPU 12, operational areas, and the like. The CPU 12 controls the other units using a unit control circuit 14. A detector group 50 observes conditions within the printer 1, and the controller 10 controls other units on the basis of the detection results.

A conveying unit 20 is used for conveying a medium S from an upstream side to a downstream side in the direction in which the medium S continues (hereinbelow, the conveying direction or the X direction). The rolled medium S prior to printing is supplied to a printing area by a conveying roller 21 driven by a motor, after which the printed medium S is wound into a roll by a winding mechanism. The medium positioned in the printing area during printing can be held by vacuum suction from below, and the medium S can thereby be held in a predetermined position.

A drive unit 30 is used for freely moving a head unit 40 in an X direction corresponding to the conveying direction of the medium S and a Y direction corresponding to the paper width direction of the medium S. The drive unit 30 is configured from an X-axis stage 31 for moving the head unit 40 in the X direction, a Y-axis stage 32 for moving the head unit 40 in the Y direction, and a motor (not shown) for moving these stages.

The head unit 40 is for forming images, and the heat unit has a plurality of heads 41. A plurality of nozzles are provided on the bottom surface of the heads 41, and ink is discharged from the nozzles. The system of discharging ink from the nozzles can be a piezo system or a thermal system.

Figure 3:
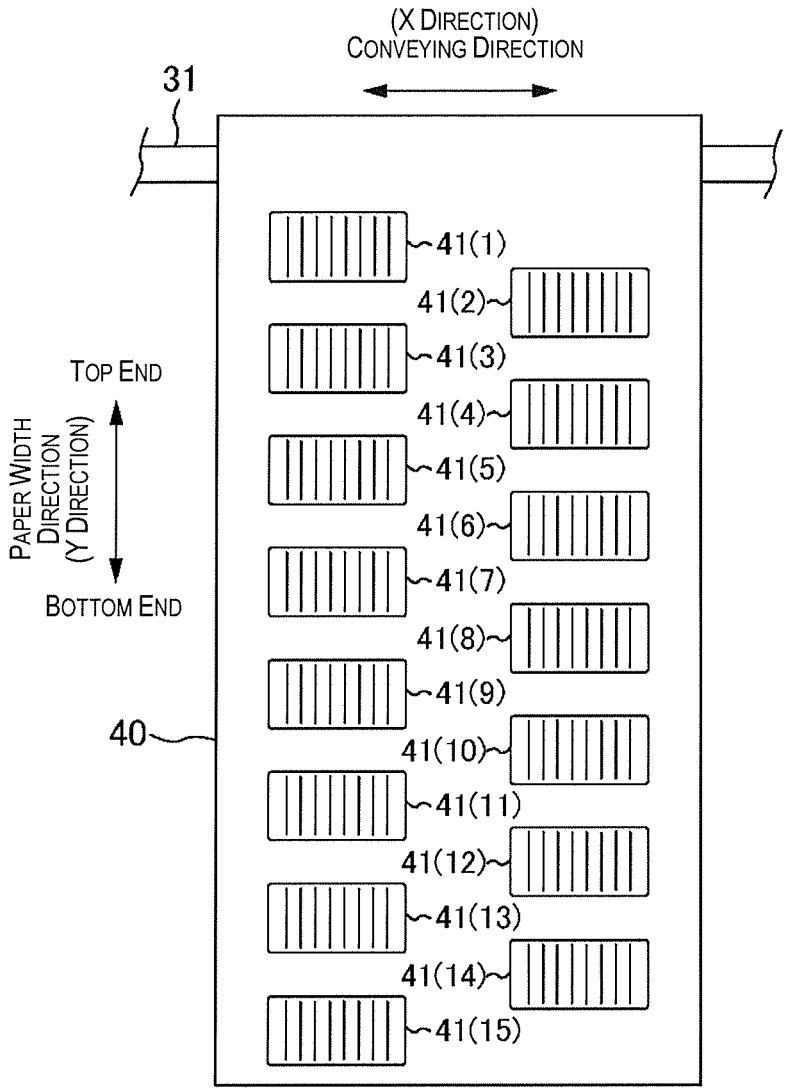
FIG. 3 is a drawing showing the arrangement of a plurality of heads 41 in a head unit 40.

FIG. 3 is a drawing showing the arrangement of the plurality of heads 41 in the head unit 40. FIG. 3 shows the arrangement of heads as virtually seen from the top surface of the head unit 40. (Therefore, the actual arrangement of heads is the horizontal reverse of the arrangement depicted.) The head unit 40 has fifteen heads 41. The fifteen heads 41 are arranged at different positions in the Y direction. For the sake of the description, the heads are referred to as the first head 41 (1), the second head 41 (2), . . . , and the fifteenth head 41 (15) in order beginning with the head 41 at the top end of the Y direction. The fifteen heads 41 are aligned in staggered rows in the Y direction. Therefore, odd-numbered heads are aligned with each other in the Y direction, and even-numbered heads are aligned with each other in the Y direction.

Figure 4:
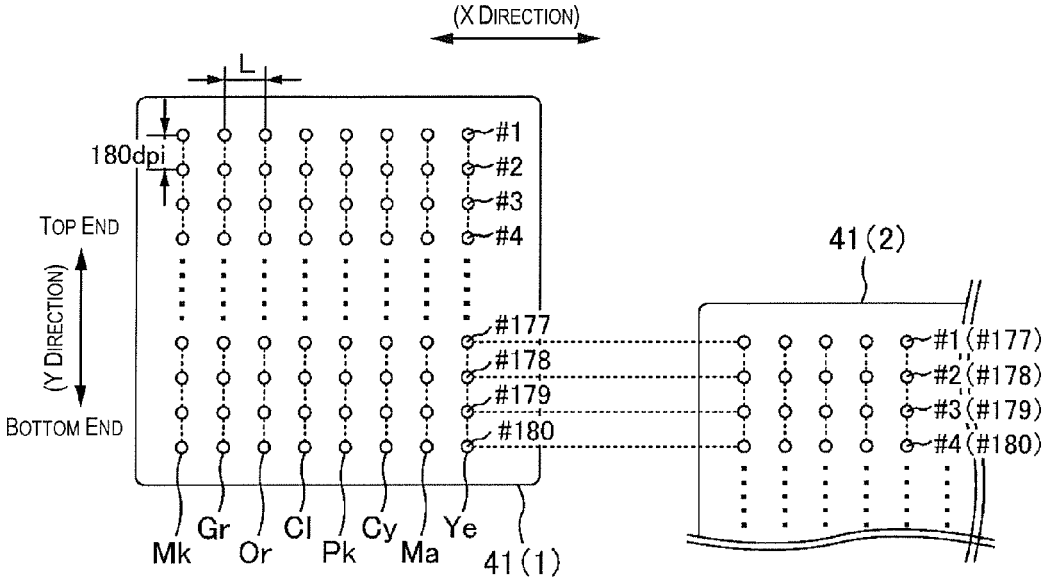
FIG. 4 is a drawing showing the arrangement of nozzles in a head 41.

FIG. 4 is a drawing showing the arrangement of nozzles in a head 41. The drawing shows the arrangement of nozzles as virtually seen from the top surface of the head unit 40. (Therefore, the actual arrangement of nozzles is the horizontal reverse of the arrangement depicted.) The heads each have eight nozzle rows. The rows in order from the left side of the drawing are a matte black nozzle row (the Mk row hereinbelow) for discharging matte black ink, a green nozzle row Gr (the Gr row hereinbelow) for discharging green ink, an orange nozzle row (the Or row hereinbelow) for discharging orange ink, a clear nozzle row Cl (the Cl row hereinbelow) for discharging clear ink, a photo black nozzle row (the Pk row hereinbelow) for discharging photo black ink, a cyan nozzle row Cy (the Cy row hereinbelow) for discharging cyan ink, a magenta nozzle row (the Ma row hereinbelow) for discharging magenta ink, and a yellow nozzle row (the Ye row hereinbelow) for discharging yellow ink.

The nozzle rows each have 180 nozzles. The 180 nozzles are aligned at a fixed nozzle pitch (1/180 inch) in the Y direction. For the sake of the description, the numbering proceeds in order beginning with the nozzles at the top end in the Y direction (#1 to #180). Between heads having adjacent positions in the Y direction (e.g., the first head 41 (1) and the second head 41 (2)), the positions in the Y direction of the four bottom end nozzles (the #177 nozzles, the #178 nozzles, the #179 nozzles, and the #180 nozzles) of the top end head (e.g. the first head 41 (1)) coincide with those of the four top end nozzles (the #1 nozzles, the #2 nozzles, the #3 nozzles, and the #4 nozzles) of the bottom end head (the head 41(2)). Specifically, heads having adjacent positions in the Y direction are arranged with four nozzles overlapping. Two nozzles whose Y-directional positions coincide can form dots while mutual interpolation is carried out. By arranging the fifteen heads while overlapping some nozzles in this manner, the head unit 40 can be regarded as a single large imaginary head (or a single large imaginary nozzle row).

Figure 5:
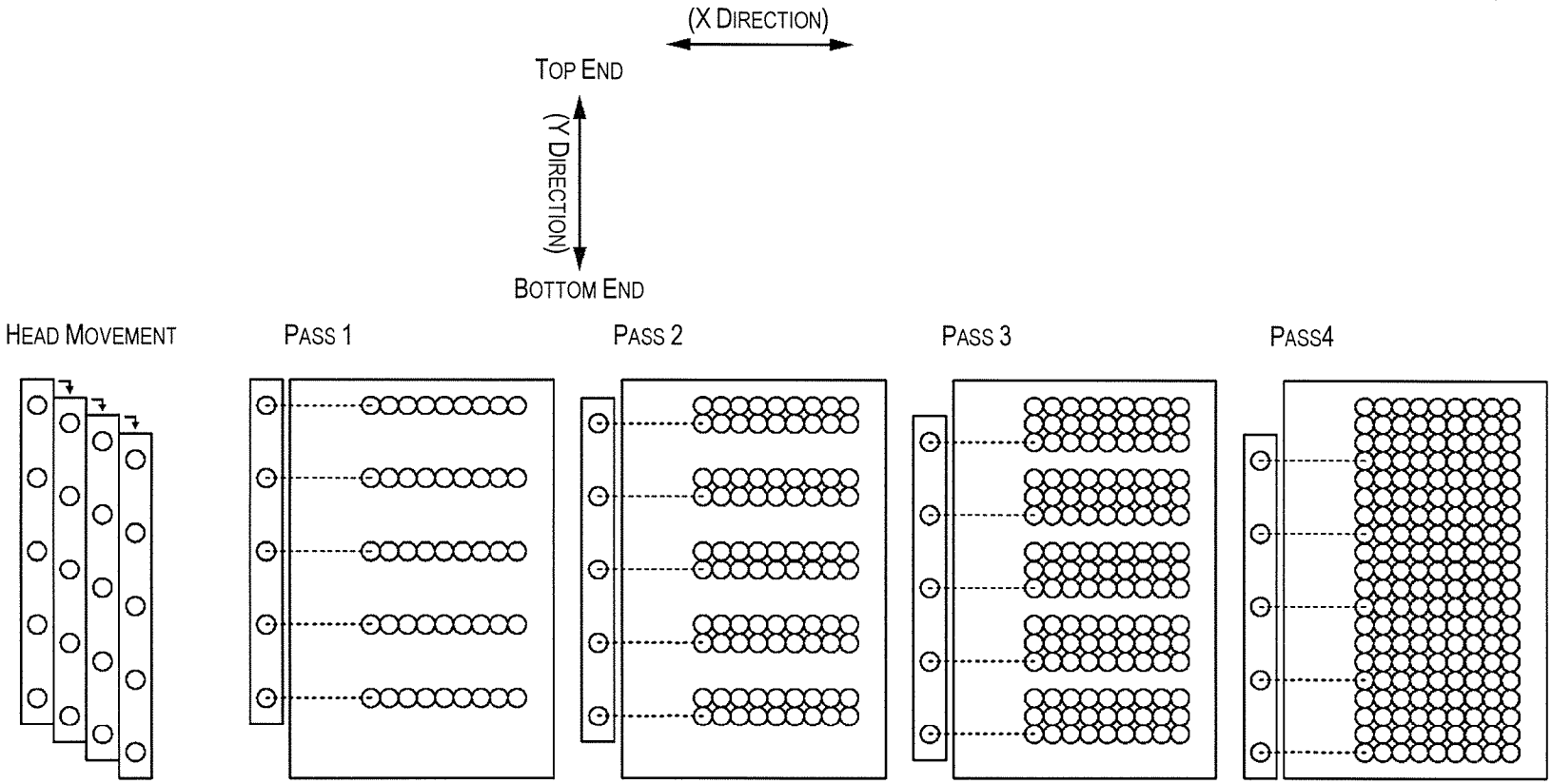
FIG. 5 is an explanatory drawing of a printing method.

FIG. 5 is an explanatory drawing of a printing method. To simplify the description, a single nozzle row is shown, and five nozzles are provided to the single nozzle row. First, the controller 10 supplies the medium S to the printing area using the conveying unit 20. The controller then repeats a dot formation action of discharging ink from the nozzles to form dots while moving the head unit 40 in the X direction (the medium conveying direction) with the X-axis stage 31, and a relative movement action of moving the head unit 40 downstream in the Y direction (the paper width direction) by the Y-axis stage 32 via the X-axis stage 31. The dot formation action is sometimes referred to as a "pass," and the nth pass is sometimes referred to as "pass n."

The nozzles can form dot rows configured from dots aligned in the X direction by discharging ink while moving in the X direction. In one pass, it is possible to form a plurality of dot rows aligned at intervals of 1/180 inch equivalent to the nozzle pitch. By performing the relative movement action during passes 1 through 4, it is possible in four passes to form a plurality of dot rows aligned in the Y direction at intervals of 1/720 inch.

After an image has been formed in the printing area by four passes, the controller 10 causes the medium S to be supplied to the printing area by the conveying unit 20. The area on which the image is formed is thereby conveyed downstream in the conveying direction, and an area on which no image is yet formed is supplied to the printing area.

Configuration of Discharge Inspection Part

Figure 6:
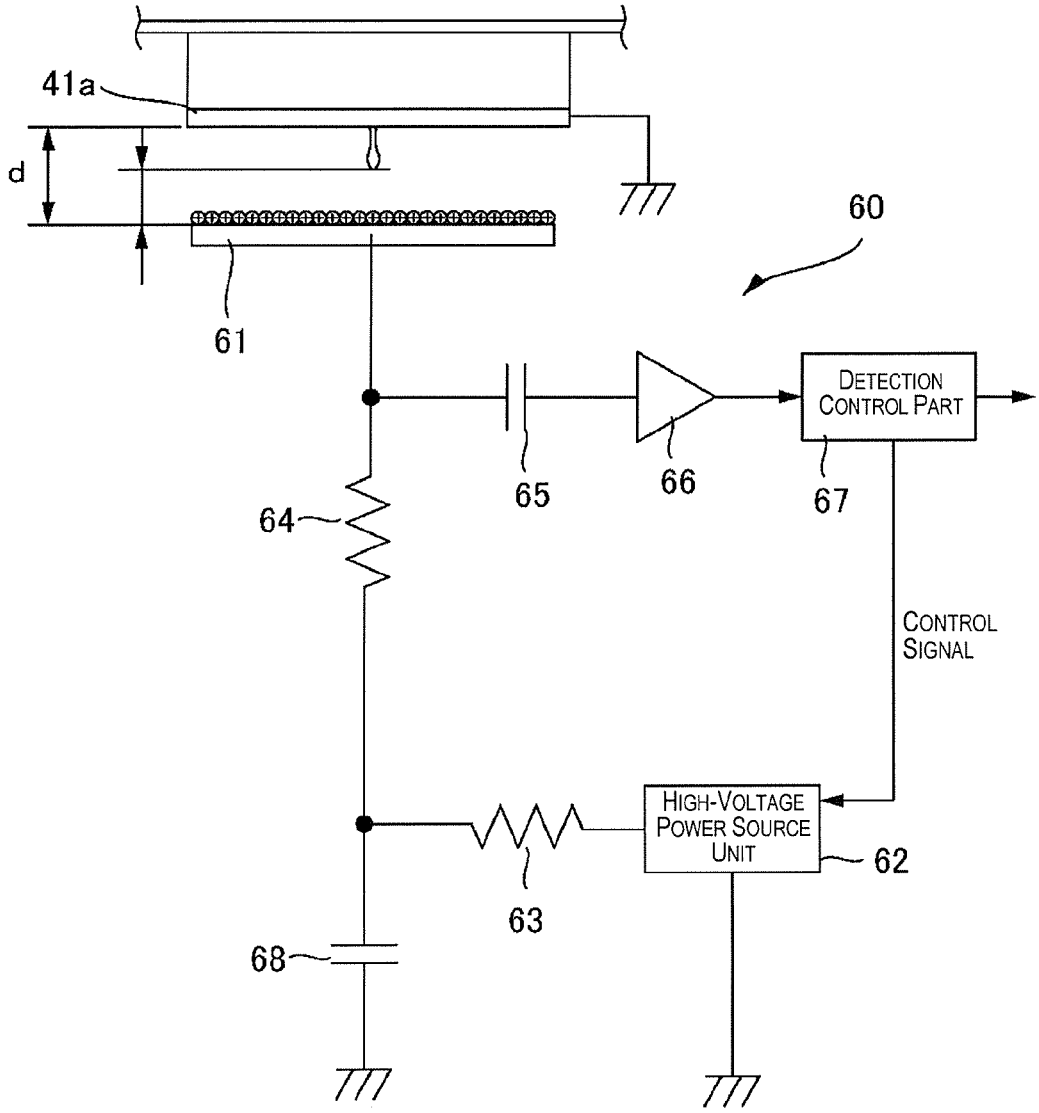
FIG. 6 is an explanatory drawing of a discharge inspection part.

FIG. 6 is an explanatory drawing of a discharge inspection part 60. The discharge inspection part 60 is used for inspecting whether or not there is a discharge of ink from the nozzles.

The discharge inspection part 60 has a plate-shaped electrode 61, a high-voltage power source unit 62, a first limiting resistor 63, a second limiting resistor 64, a detection capacitor 65, an amplifier 66, a detection control part 67, and a smoothing capacitor 68. A nozzle plate 41*a* of the head 41 is grounded and is also made to function as part of the discharge inspection part. The nozzle plate 41*a* fulfills the function of a first electrode for bringing the ink discharged from the nozzles to ground potential.

The plate-shaped electrode 61 is formed from a metal plate. This plate-shaped electrode 61 fulfills the function of a second electrode provided to a position facing the nozzles. Only one plate-shaped electrode 61 is shown in FIG. 6, but the printer 1 of the present embodiment has a plurality of plate-shaped electrodes 61 in order to perform discharge inspection of a plurality of heads 41. The discharge inspection part shown in FIG. 6 is configured for each of the plurality of plate-shaped electrodes 61.

The high-voltage power source unit 62 is a power source for bringing the plate-shaped electrode 61 to a predetermined electric potential. The high-voltage power source unit of the present embodiment is configured by a direct current power source of about 600 V to 1000 V.

The first limiting resistor 63 and the second limiting resistor 64 are arranged between the high-voltage power source unit 62 and the plate-shaped electrode 61, and these resistors control the electric current flowing between the high-voltage power source unit 62 and the plate-shaped electrode 61. The first limiting resistor 63 and the second limiting resistor 64 of the present embodiment both have resistance values of 1.6 MΩ.

The detection capacitor 65 is an element for extracting electric-phase-changing components of the plate-shaped electrode 61. One end of the detection capacitor 65 is connected to the plate-shaped electrode 61, and the other end is connected to the amplifier 66. Bypass components (direct current components) of the plate-shaped electrode 61 are removed by the detection capacitor 65. The detection capacitor 65 of the present embodiment has a capacitance of 4700 pF.

The amplifier 66 amplifies signals at the other end of the detection capacitor 65. The amplifier 66 of the present embodiment has an amplification factor of 4000 times. A detection signal whose electric potential changes by about 3 V can thereby be acquired from the amplifier 66.

The detection control part 67 controls the discharge inspection part 60. For example, the detection control part 67 controls the actions of the high-voltage power source unit 62. Based on a detection signal (an analog signal) from the amplifier 66, the detection control part 67 also judges whether or not the nozzles that are inspection targets are discharging ink (whether or not the nozzles that are inspection targets are irregular nozzles) and outputs the judgment results as a digital signal to the controller 10. Specifically, the detection control part 67 is a judgment part for judging whether or not there is a discharge of ink from nozzles on the basis of electric potential changes occurring in the plate-shaped electrode.

The smoothing capacitor 68 minimizes sudden changes in electric potential. One end of the smoothing capacitor 68 is connected to the first limiting resistor 63 and the second limiting resistor 64, and the other end is grounded. The smoothing capacitor 68 of the present embodiment has a capacitance of 0.1 μF.

Figure 7:
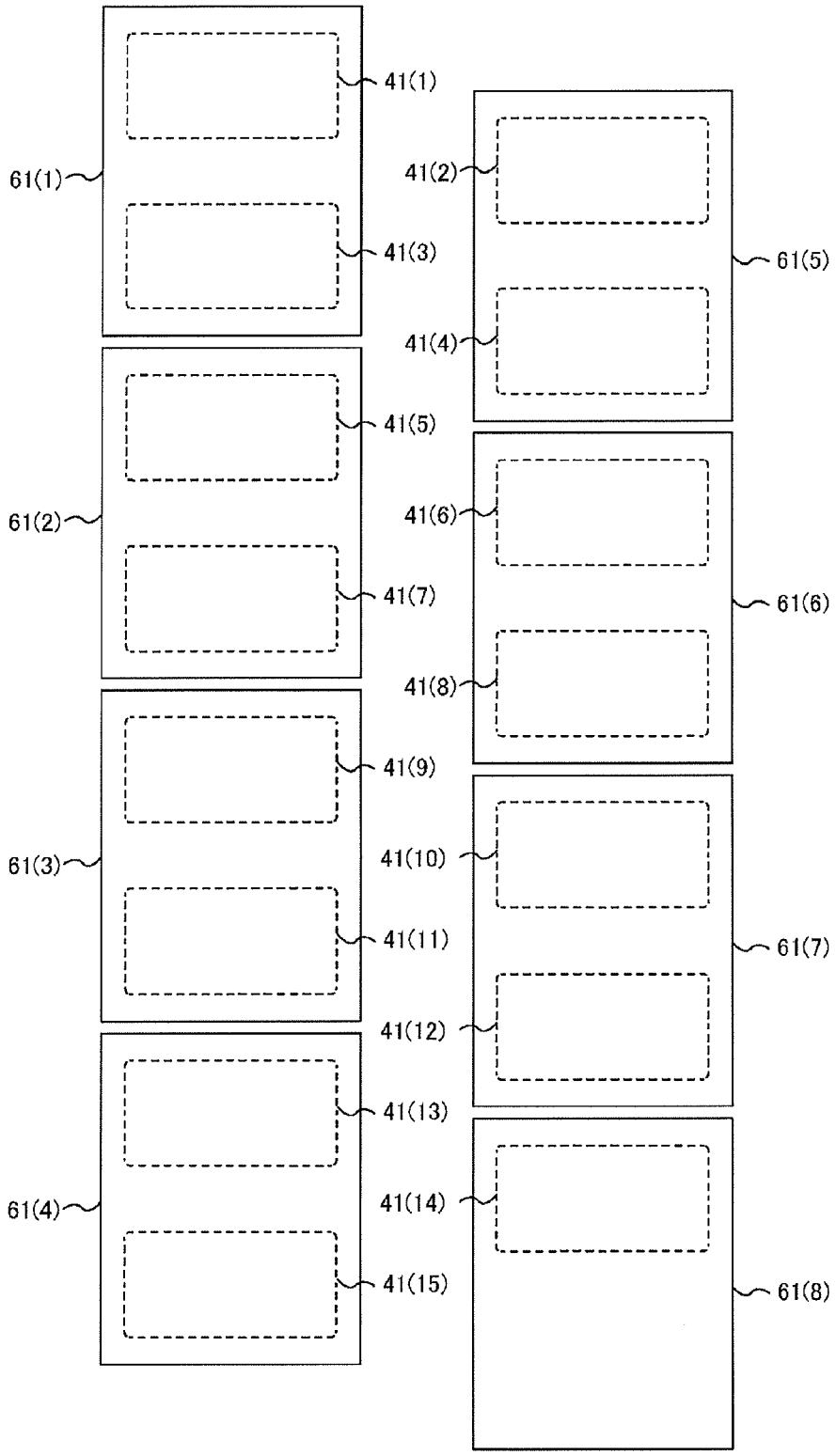
FIG. 7 is a drawing showing the arrangement of eight plate-shaped electrodes 61.

FIG. 7 is a drawing showing the arrangement of eight plate-shaped electrodes 61. The eight plate-shaped electrodes 61 are arranged at different positions in the Y direction. Four of the eight plate-shaped electrodes 61 are aligned in the Y direction, and the other four are also aligned in the Y direction. In other words, two rows are aligned in the X direction, each row containing four plate-shaped electrodes 61 aligned in the Y direction. For the sake of the description, the four plate-shaped electrodes 61 in the left-side row in the drawing are referred to in order, beginning with the top end in the Y direction, as the first plate-shaped electrode 61 (1), the second plate-shaped electrode 61 (2), the third plate-shaped electrode 61 (3), and the fourth plate-shaped electrode 61 (4). The four plate-shaped electrodes 61 in the right-side row in the drawing are referred to in order, beginning with the top end in the Y direction, as the fifth plate-shaped electrode 61 (5), the sixth plate-shaped electrode 61 (6), the seventh plate-shaped electrode 61 (7), and the eighth plate-shaped electrode 61 (8). The rows of the first through fourth plate-shaped electrodes 61 (1) to 61 (4) are staggered in the Y direction from the rows of the fifth through eighth plate-shaped electrodes 61 (5) to 61 (8) by an amount approximately proportionate to one head 41.

Though not shown in the drawing, the discharge inspection part 60 shown in FIG. 6 is configured for each of the eight plate-shaped electrodes 61. In accordance with the numbers assigned to the plate-shaped electrodes 61, the eight discharge inspection parts 60 are sometimes referred to respectively as the first discharge inspection part 60 (1), the second discharge inspection part 60 (2), . . . , and the eighth discharge inspection part 60 (8).

In the drawing, the positions of the fifteen heads during discharge inspection are shown by dotted lines. Each of the plate-shaped electrodes 61 is provided so as to face two heads 41 as shown in the drawing. For example, the first plate-shaped electrode 61 (1) is provided so as to face the first head 41 (1) and the third head 41 (3). The eighth plate-shaped electrode 61 (8), however, faces only the fifteenth head (15).

The eight plate-shaped electrodes 61 are provided upstream in the conveying direction from the printing area, as shown in FIGS. 2A and 2B. During discharge inspection of the nozzles, the controller 10 moves the head unit 40 upstream in the conveying direction and causes the fifteen heads 41 of the head unit 40 to face the respective plate-shaped electrodes 61.

Principles of Discharge Inspection

When ink is discharged from the nozzles of the nozzle plate 41*a*, the electric potential of the plate-shaped electrode 61 changes, the detection capacitor 65 and the amplifier 66 detect this electric potential change, and a detection signal is outputted to the detection control part 67. Though irregular nozzles can attempt to discharge ink, ink is not discharged (or the proper amount of ink is not discharged); therefore, the electric potential of the plate-shaped electrode 61 does not change and the detection signal shows no voltage change.

The underlying principle is not precisely clarified, but is presumably as follows. It is generally known that when there is a change in the space d between two conductors constituting a capacitor, the electric charge Q stored in the capacitor changes. When ink is discharged from the ground potential nozzle plate 41*a* toward the high-potential plate-shaped electrode 61, the space d (see FIG. 6) between the ground potential ink droplets and the plate-shaped electrode 61 changes, and the electric charge Q stored in the plate-shaped electrode 61 changes in the same manner as when the space d between the two conductors of the capacitor had changed. The result is thought to be that the electric charge moves to the plate-shaped electrode 61, the electric current flowing at this time is detected by the detection capacitor 65 and the amplifier 66, and a detection signal is outputted to the detection control part 67.

In the present embodiment, when control is performed for causing ink to be discharged from the nozzles that are inspection targets (when the drive signal COM is applied to the piezo elements of the nozzles that are inspection targets), the detection control part 67 detects whether or not there has been a predetermined voltage change in the detection signal, and a judgment is made of whether or not the nozzles that are inspection targets are discharging ink (whether or not the nozzles that are inspection targets are irregular nozzles), using the phenomenon described above.

When ink droplets have been discharged from the nozzles of the nozzle plate 41*a*, it is believed that the electric charge Q stored in the electrode changes due to a change in electrostatic capacitance in an area about 5 mm in radius facing the nozzles. Since the plate-shaped electrode 61 is used in the present embodiment, stable discharge inspection can be achieved because the electrostatic capacitance changes in an area of approximately the same size no matter which nozzles discharge ink droplets. If a wire electrode were to be used instead of the plate-shaped electrode 61, the area of the electrode facing the nozzles would change depending on the positions of the nozzles discharging ink.

Action During Discharge Inspection

1. Detection Signal of Discharge Inspection

Figure 8A:
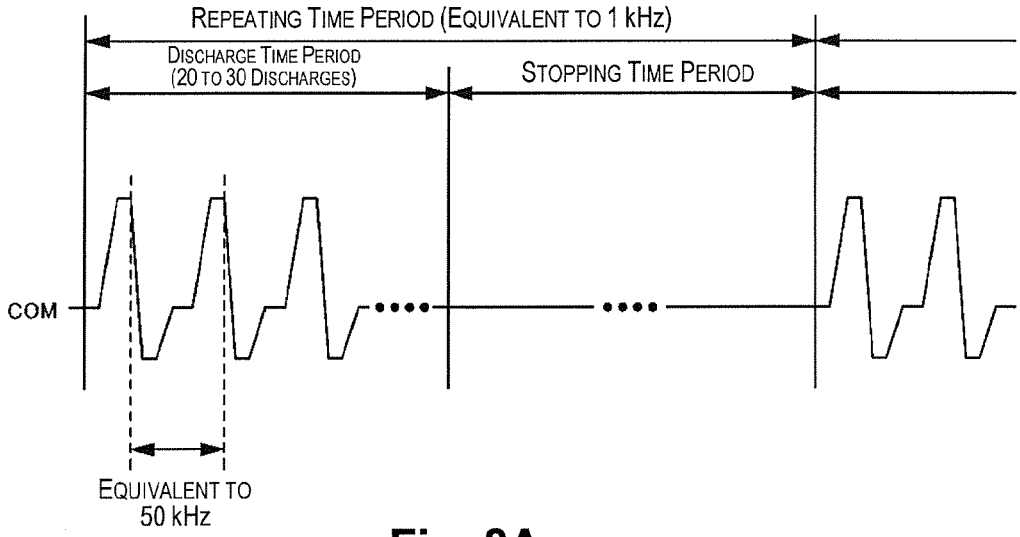
FIG. 8A is an explanatory chart of a drive signal COM for driving a piezo element.

FIG. 8A is an explanatory chart of a drive signal COM for driving a piezo element. The controller 10 repeatedly outputs a drive signal COM such as the one shown in the drawing in 1 kHz cycles. The controller 10 outputs such a drive signal COM to each of the heads 41. The controller 10 then applies the drive signal COM to the piezo elements of the nozzles that are inspection targets.

The repeating time period in the drawing is the time period needed for one discharge judgment of a single nozzle. The drive signal COM of the first half of this time period includes twenty to thirty ink discharge pulses in an interval equivalent to 50 kHz. The drive signal COM of the second half has a constant electric potential (an intermediate electric potential). When such a drive signal COM is applied to a piezo element, twenty to thirty ink droplets are discharged in an interval equivalent to 50 kHz from the nozzle corresponding to the piezo element.

Figure 8B:
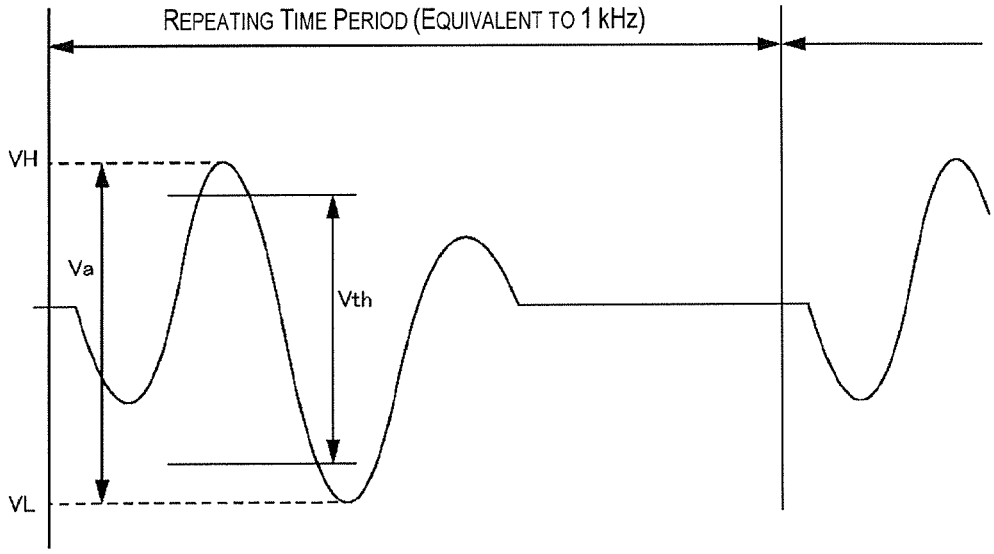
FIG. 8B is an explanatory chart of a detection signal when ink droplets have been discharged.

FIG. 8B is an explanatory chart of a detection signal when ink droplets have been discharged. When twenty to thirty ink droplets are discharged in an interval equivalent to 50 kHz from the nozzle during the repeating time period of FIG. 8A, a detection signal such as the one shown in FIG. 8B is outputted from the amplifier 66.

The detection control part 67 detects the amplitude Va (the difference between the maximum electric potential VH and the minimum electric potential VL of the detection signal) of the detection signal outputted from the amplifier 66 during a certain repeating time period, and compares the detected amplitude Va with a pre-established threshold Vth (e.g. 3 V). If the amplitude Va of the detection signal is greater than the threshold Vth, the detection control part 67 judges that ink is being discharged regularly from the nozzles that are inspection targets. Conversely, if the amplitude Va of the detection signal is less than the threshold Vth, the detection control part 67 judges that ink is not being discharged from the nozzles that are inspection targets.

2. Discharge Inspection of Nozzles: Unit Blocks

Figure 9A:
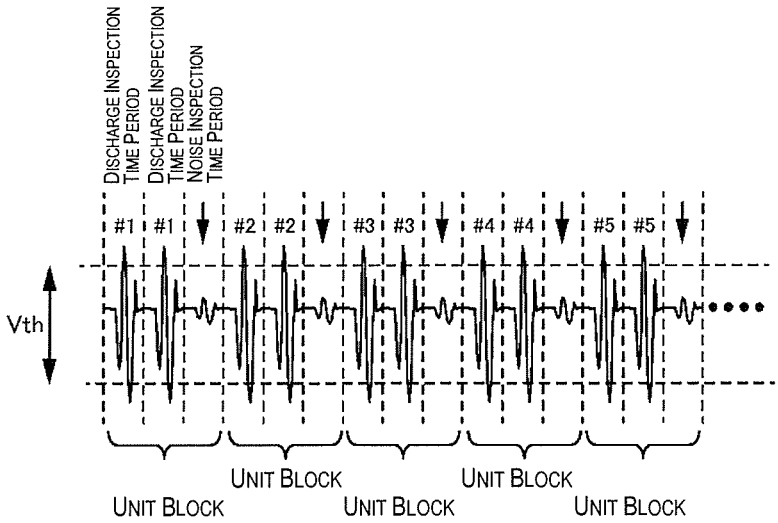
FIGS. 9A and 9B are explanatory charts of detection signals during a discharge inspection of the present embodiment.
Figure 9B:
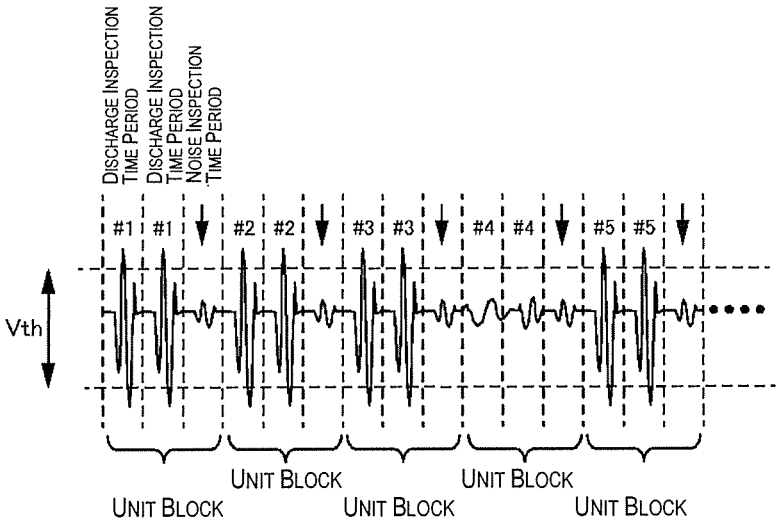
Figure 10A:
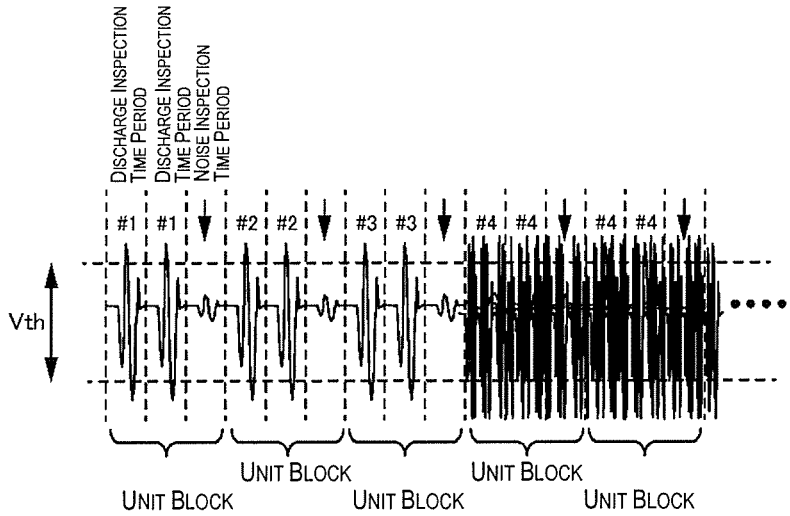
FIGS. 10A and 10B are explanatory charts of detection signals when noise is involved.
Figure 10B:
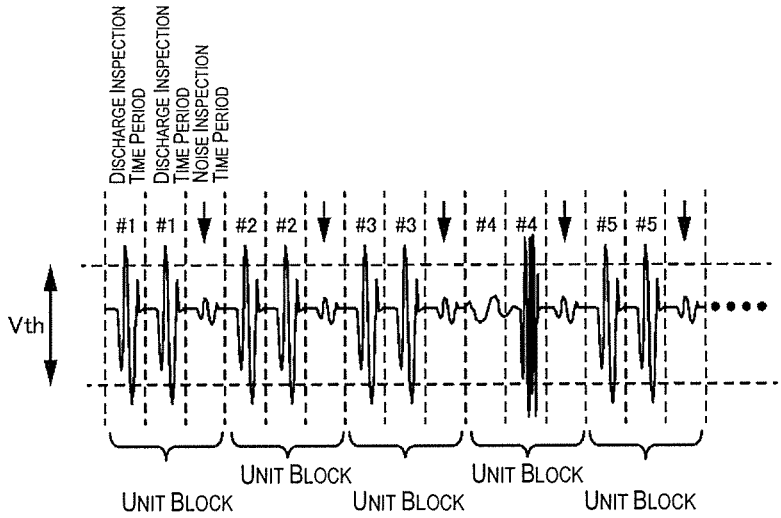

FIGS. 9A and 9B are explanatory charts of detection signals during a discharge inspection of the present embodiment. FIGS. 10A and 10B are explanatory charts of detection signals when noise is involved.

A unit block in the drawing is a unit action for performing one discharge inspection on a single nozzle. Each of the unit blocks is equivalent to three repeating time periods of FIG. 8A and is composed of two discharge inspection time periods and one noise inspection time period.

In the discharge inspection time period, the controller 10 applies the drive signal COM shown in FIG. 8A to the piezo element of the nozzle being inspected. As a result, if the nozzle is regular, the amplitude Va of the detection signal exceeds the threshold Vth during the discharge inspection time period of the unit block. If the nozzle is irregular, the amplitude Va of the detection signal does not exceed the threshold Vth during the discharge inspection time period of the unit block (refer to the discharge inspection time periods of nozzle #4 in FIG. 9B).

During the noise inspection time period, the controller 10 does not apply the drive signal COM to the piezo elements of any nozzles. Specifically, the noise inspection time period is a non-discharge time period in which ink droplets are not discharged. Therefore, regardless of the state of the nozzle, if the amplitude Va of the detection signal detected during the noise inspection time period does not exceed the threshold Vth, it is judged that the detection signal contains noise.

If noise enters the detection signal for a comparatively long time period as shown in FIG. 10A, the amplitude Va of the detection signal during the noise inspection time period of the unit block exceeds the threshold Vth. Therefore, when the amplitude Va of the detection signal of the noise inspection time period has exceeded the threshold Vth, noise is believed to be included in the detection signal of the discharge inspection time period of the same unit block as well. Consequently, in such cases, the unit block is implemented a second time using the same nozzle as the inspection target but without using the detection signal of this unit block, and the nozzle discharge judgment is performed based on the detection signal of the unit block when no noise was included during the noise inspection time period.

Short-term noise (spike noise) is sometimes included in the detection signal as shown in FIG. 10B. When such spike noise is included in the detection signal, the inclusion of noise cannot be detected merely with the detection signal of the noise inspection time period.

Figure 11A:
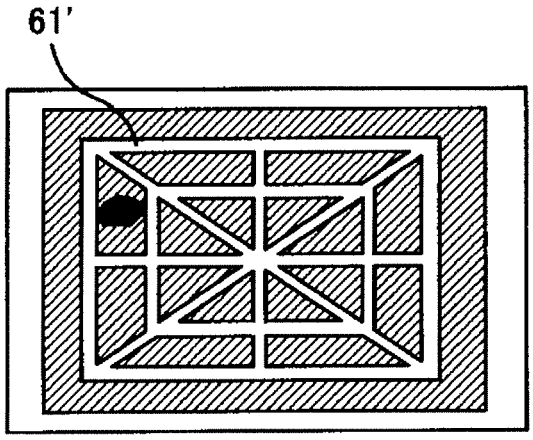
FIGS. 11A and 11B are explanatory drawings of an electrode of a reference example.
Figure 11B:
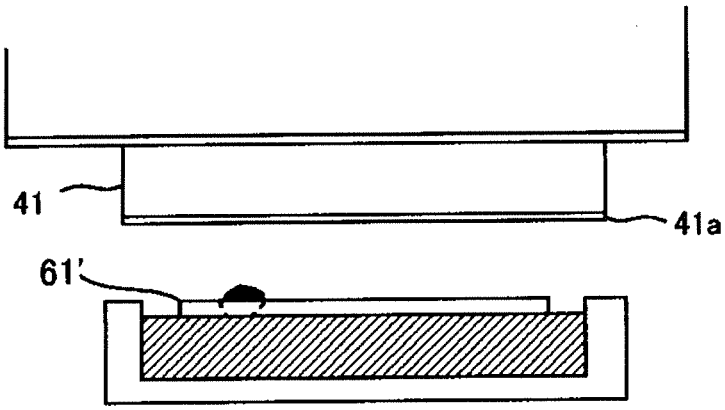

However, as a result of using a plate-shaped electrode (the plate-shaped electrode 61) as in the discharge inspection part 60 of the present embodiment, such spike noise is included in the detection signal particularly easily. The reason for this is described below. FIGS. 11A and 11B are explanatory drawings of an electrode of a reference example. This electrode 61' is the wire electrode used in the discharge inspection of Japanese Laid-open Patent Publication No. 2010-64309 (Patent Citation 1). With this wire electrode 61', the probability of waste adhering to the top of the wire is low, and the space between the electrode 61' and the nozzle plate 41*a* of the head 41 (another electrode) is not necessarily small even with waste adhering. In view of this, when the plate-shaped electrode 61 is used as in the present embodiment and waste adheres to the electrode, the space between the plate-shaped electrode 61 and the nozzle plate 41*a* will inevitably be smaller in proportion to the height of the waste, and will be smaller than when the wire electrode is used (see FIG. 11B). Therefore, when the plate-shaped electrode 61 is used, electrical discharge is likely between the waste and the nozzle plate 41*a*, and spike noise is thought to be included in the detection signal.

Figure 12A:
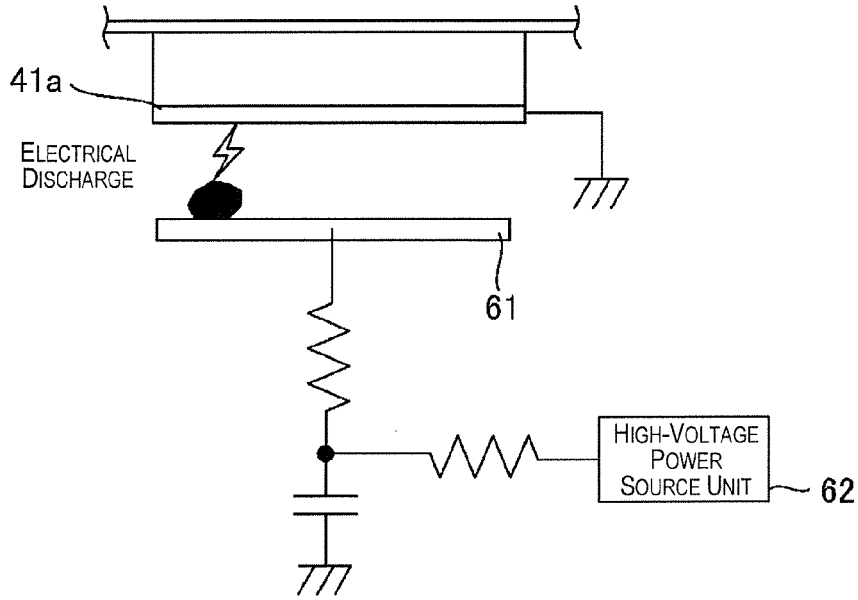
FIGS. 12A and 12B are explanatory drawings of the properties of spike noise.
Figure 12B:
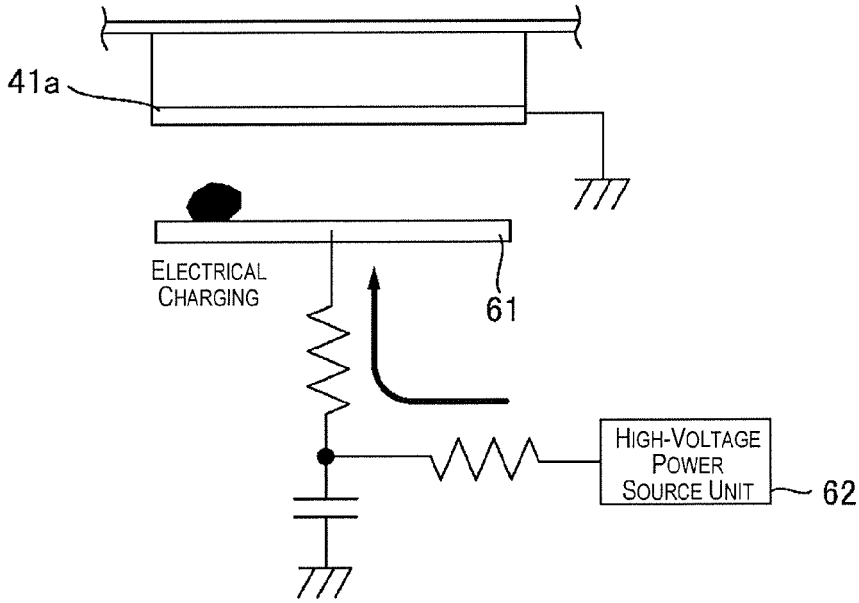

Such spike noise does not occur steadily or continuously, but it occurs in certain time periods. The reason for this is described below. FIGS. 12A and 12B are explanatory drawings of the properties of spike noise. Since spike noise is thought to be an electrical discharge phenomenon, once electrical discharge occurs (see FIG. 12A), the electric potential of the plate-shaped electrode 61 decreases, and the plate-shaped electrode 61 must therefore be restored to a high electric potential in order for the next electrical discharge to occur. Specifically, the plate-shaped electrode 61 must be electrically charged after electrical discharge (FIG. 12B). The result can be that after the spike noise occurs, a time period equivalent to the electrical charging time period will elapse by the time the next spike noise occurs. Specifically, the spike noise is believed not likely to occur continuously during extremely short time periods.

In view of this, in the present embodiment, the property of spike noise not occurring steadily or continuously is used to avoid erroneous inspection caused by spike noise. Specifically, an erroneous inspection caused by spike noise is avoided by continuously providing a plurality of discharge inspection time periods within a unit block, and performing nozzle discharge inspections on the basis of the detection signals in these discharge inspection time periods.

Figure 13:
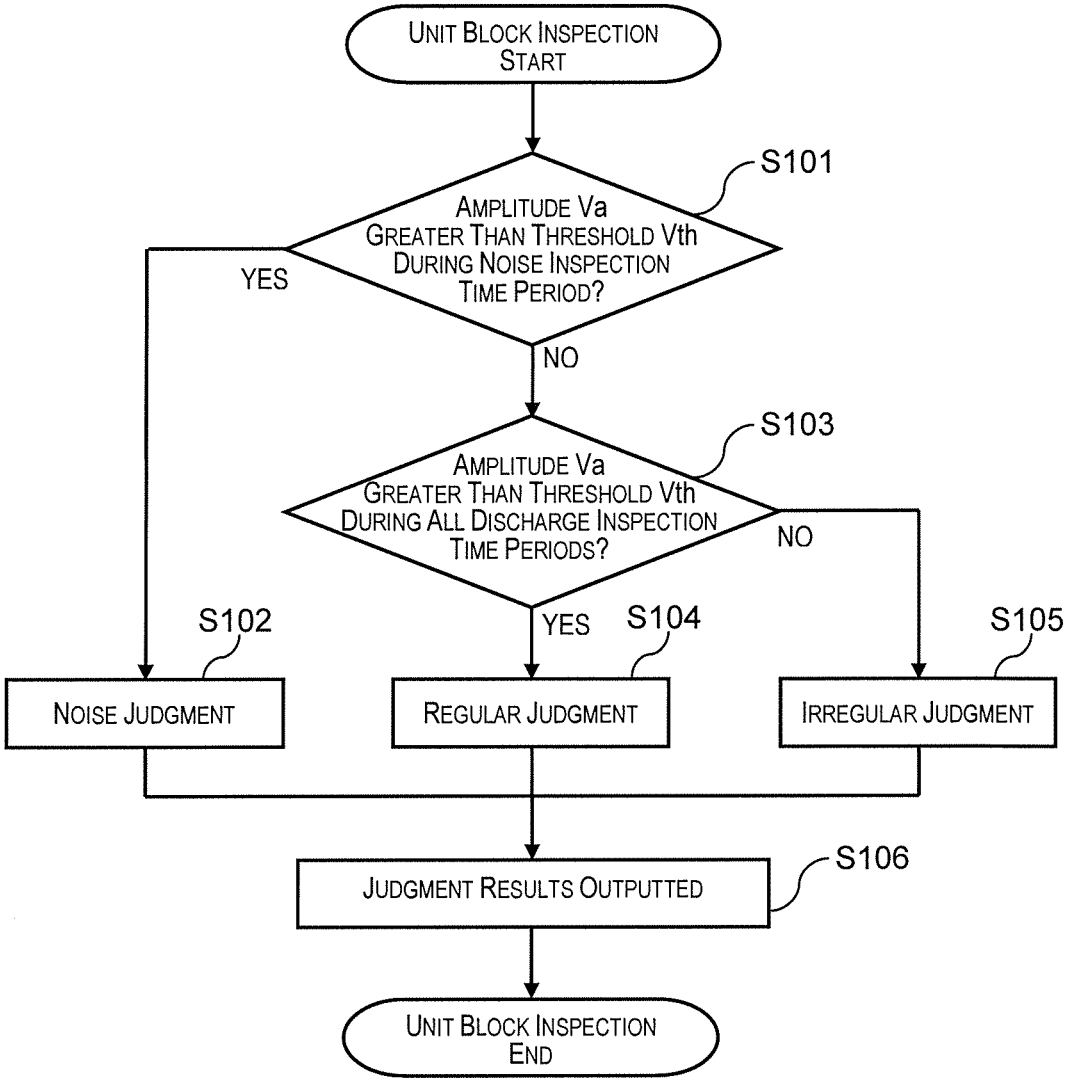
FIG. 13 is an explanatory chart of the process flow of a unit block.

FIG. 13 is an explanatory chart of the process flow of a unit block. This process is performed by the detection control part 67 of the discharge inspection part 60.

First, the detection control part 67 detects the amplitude Va of the detection signal (the difference between the maximum electric potential VH and the minimum electric potential VL of the detection signal) outputted from the amplifier 66 during the noise inspection time period of the unit block, and compares the detected amplitude Va with a pre-established threshold Vth (e.g. 3 V) (S101). If the amplitude Va detected during the noise inspection time period is greater than the threshold Vth (YES in S101), the detection control part 67 judges that noise is included in the unit block without performing a discharge judgment based on the detection signal of the discharge inspection time period of the same unit block (S103 to S105, a judgment of whether or not there is a discharge of ink from the nozzle). This judgment is hereinbelow referred to as the "noise judgment." For example, in the case of a detection signal such as the one of FIG. 10A, the detection control part 67 performs the "noise judgment" in the process of the unit block whose inspection target is nozzle #4. When the "noise judgment" is performed, the controller 10 again implements the unit block whose inspection target is the same nozzle.

If the amplitude Va detected during the noise inspection time period is less than the threshold Vth (NO in S101), the detection control part 67 performs a discharge judgment on the basis of the detection signals of a plurality of discharge inspection time periods of the same unit block (S103 to S105). The term "discharge judgment" indicates the judging of whether or not there is a discharge of ink from the nozzle and does not include the judging of whether or not there is noise.

First, the detection control part 67 determines whether or not the detected amplitude Va is greater than the threshold Vth during all time periods of a plurality of discharge inspection time periods (S103).

In all of the discharge inspection time periods of the unit block, if the detected amplitude Va is greater than the threshold Vth (YES in S103), the detection control part 67 judges that ink is being discharged regularly from the nozzle being inspected (S104). Specifically, having judged that ink is being discharged from the nozzle (YES in S103) in all of the discharge inspection time periods of the unit block, the detection control part 67 makes a generalized judgment that ink is being discharged from the nozzle being inspected (S104). This judgment is referred to hereinbelow as a "regular judgment." For example, in the case of a detection signal such as the one of FIG. 10B, the detection control part 67 performs a "regular judgment" in the process of the unit block whose inspection target is nozzle #1.

If the amplitude Va detected in any discharge inspection time period of the unit block is less than the threshold Vth (NO in S103), the detection control part 67 judges that ink is not being discharged from the nozzle being inspected (S105). Specifically, having judged that ink is not being discharged from the nozzle (YES in S103) in any discharge inspection time period of the unit block, the detection control part 67 makes a generalized judgment that ink is not being discharged from the nozzle being inspected (S104). This judgment is hereinbelow referred to as an "irregular judgment."

In the detection signal shown in FIG. 10B, spike noise is included in the unit block whose inspection target is nozzle #4. Even if spike noise is included in this manner, the detection control part 67 of the present embodiment can perform an "irregular judgment" in the process of the unit block whose inspection target is nozzle #4.

As has already been described, spike noise has the property of not occurring steadily or continuously. Therefore, if a plurality of discharge inspection time periods are continuously provided in the same unit block, circumstances where spike noise is included in the detection signal of all discharge inspection time periods are not likely to occur even if spike noise is included in the detection signals Consequently, if a nozzle not discharging ink is the inspection target, the amplitude Va of the detection signal will be less than the threshold Vth (it will be judged that ink is not being discharged from the nozzle) in any discharge inspection time period. This fact is used to avoid erroneous inspection caused by spike noise.

When noise is included in all the discharge inspection time periods of a unit block (see FIG. 10A, for example), comparatively long-term noise is believed to be included rather than spike noise. When comparatively long-term noise is included, the amplitude Va of the detection signal of the noise inspection time period is greater than the threshold Vth (YES in S101), and the discharge judgments of S103 to S105 are therefore not performed. Therefore, erroneous inspection caused by noise can be avoided even if the amplitude Va of the detection signal exceeds the threshold Vth in all time periods of the unit block due to noise.

After the judgments of the noise judgment (S102) and a regular judgment (S104) or an irregular judgment (S105), the detection control part 67 outputs the judgment results to the controller 10.

3. Sequence of Discharge Inspection

Figure 14:
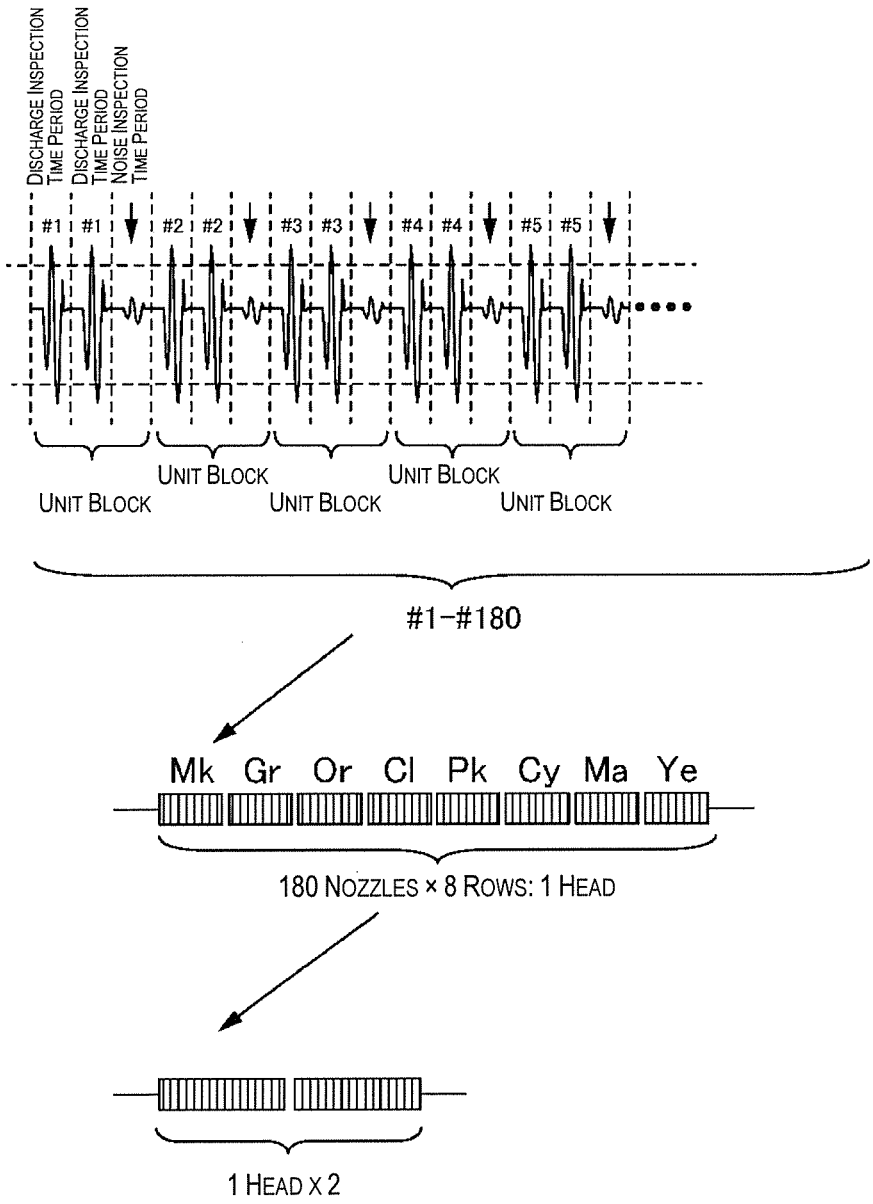
FIG. 14 is an explanatory chart of the action during discharge inspection of a discharge inspection part 60.

FIG. 14 is an explanatory chart of the action during discharge inspection of a discharge inspection part 60. The action during discharge inspection by the first discharge inspection part 60 (1) is described herein. The description herein omits the re-implementing of a unit block due to noise.

First, the controller 10 implements the unit block whose inspection target is nozzle #1 of the matte black nozzle row (the Mk row of FIG. 4) of the first head 41 (1). Following an instruction from the controller 10, the head unit 40 applies a drive signal COM in the discharge inspection time period to the piezo element of nozzle #1 of the matte black nozzle row (the Mk row of FIG. 4) of the first head 41 (1), and does not apply a drive signal COM to the piezo element of any nozzle in the noise inspection time period. The first discharge inspection part 60 (1) outputs the judgment results to the controller 10.

When the discharge inspection of nozzle #1 of the matte black nozzle row Mk (see FIG. 4) has ended, the controller 10 then implements the unit block whose inspection target is nozzle #2 of the same nozzle row. Thus, the controller 10 performs discharge inspection until nozzle #180 of the matte black nozzle row Mk.

When discharge inspection of the matte black nozzle row Mk has ended, the controller 10 then performs discharge inspections in order on the 180 nozzles of the green nozzle row Gr. Thus, the controller 10 performs discharge inspections in order on the nozzles of the eight nozzle rows of the head 41. Discharge inspection of the first head 41 (1) by the first discharge inspection part 60 is thereby performed.

When discharge inspection of the first head 41 (1) has ended, the controller 10 similarly performs discharge inspections on the nozzles of the eight nozzle rows of the third head 41 (3). Since the first plate-shaped electrode 61 (1) of the first discharge inspection part 60 (1) faces the first head 41 (1) and the third head 41 (3) as shown in FIG. 7, discharge inspection of the third head 41 (3) is performed next. Thus, the controller 10 uses the first discharge inspection part 60 (1) to perform discharge inspections of the nozzles of two heads 41 (the first head 41 (1) and the third head 41 (3)).

4. Parallel Processing of a Plurality of Discharge Inspections

Figure 15:
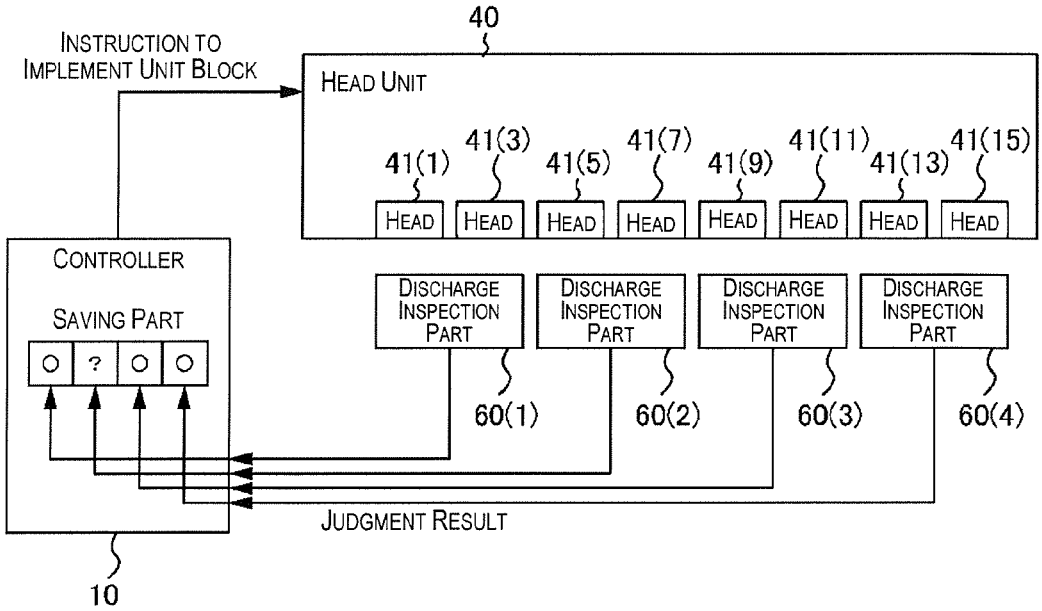
FIG. 15 is an explanatory chart of parallel processing of discharge inspection.

FIG. 15 is an explanatory chart of parallel processing of discharge inspection. The parallel processing of four discharge inspection parts 60 is described herein.

First, the controller 10 implements the unit blocks whose inspection target are nozzles #1 of the matte black nozzle rows (the Mk row of FIG. 4) of the first head 41 (1), the fifth head 41 (5), the ninth head 41 (9), and the thirteenth head 41 (13). Following an instruction from the controller 10, the head unit 40 applies a drive signal COM in the discharge inspection time period to the piezo elements of nozzles #1 of the matte black nozzle rows (the Mk row of FIG. 4) of the first head 41 (1), the fifth head 41 (5), the ninth head 41 (9), and the thirteenth head 41 (13), and does not apply a drive signal COM to the piezo elements of any nozzles in the noise inspection time period. Each of the first through fourth discharge inspection parts 60 (1) to 60 (4) outputs judgment results to the controller 10.

If none of the four judgment results include a noise judgment, the controller 10 ends discharge inspection of nozzles #1 and implements unit blocks whose inspection targets are nozzles #2 of the same nozzle rows. In this case, the controller 10 similarly changes the nozzles that are inspection targets of the four discharge inspection parts 60 from nozzles #1 to nozzles #2.

When the judgment result of the second discharge inspection part 60 (2) is a noise judgment, for example, the controller 10 re-implements the unit block whose inspection target is the same nozzle #1. If the unit block is not implemented, it is because the discharge state of nozzle #1 of the matte black nozzle row of the fifth head 41 (5) is unknown. When the unit block is re-implemented, the controller 10 calls for re-implementing of the unit block so that the same previous nozzle is the inspection target in all four discharge inspection parts 60, even if a discharge judgment (a regular judgment or an irregular judgment) has been performed in a discharge inspection part 60 other than the second discharge inspection part 60 (2). Specifically, the controller 10 calls for re-implementation of the unit block so that the same previous nozzle is the inspection target in any head 41. The instructions and processes of the controller 10 can thereby be simplified and standardized.

If discharge inspections are performed separately for each discharge inspection part 60, the nozzles that are inspection targets in each discharge inspection part 60 are random, and the instructions and process contents of the controller 10 become complicated. For example, when only the second discharge inspection part 60 (2) has yielded a noise judgment in the judgment result of the first unit block whose inspection target is nozzle #1, only the second discharge inspection part 60 (2) re-implements the unit block whose inspection target is nozzle #1, and when the unit block whose inspection target is the next nozzle #2 is implemented in another discharge inspection part 60 (3), the subsequent instructions and process contents of the controller 10 become complicated. In the present embodiment, such complicating of the processes is avoided. Thus, in the present embodiment, implementing and re-implementing of a unit block corresponding to the nozzle being inspected, changing the nozzle being inspected, and other actions are shared among the plurality of discharge inspection parts. As a result, a plurality of discharge inspection processes are performed in parallel.

When four discharge inspections are processed in parallel and even one of the four judgment results includes a noise judgment, the unit block whose inspection target is the same nozzle will be constantly re-implemented, and it will then be time-consuming to complete the discharge inspections of all the nozzles. Particularly, as a greater number of discharge inspection parts are processed in parallel, there will be a higher probability that a plurality of judgment results will include a noise judgment, and the time required for discharge inspection will be extremely long.

In view of this, even when the judgment results include a noise judgment, if the discharge inspection part 60 that has issued the noise judgment has already performed a discharge judgment (a regular judgment or an irregular judgment) on the nozzle being inspected, the controller 10 of the present embodiment completes the discharge inspection of that nozzle and makes the next nozzle the inspection target. This process is described hereinbelow.

Figure 16:
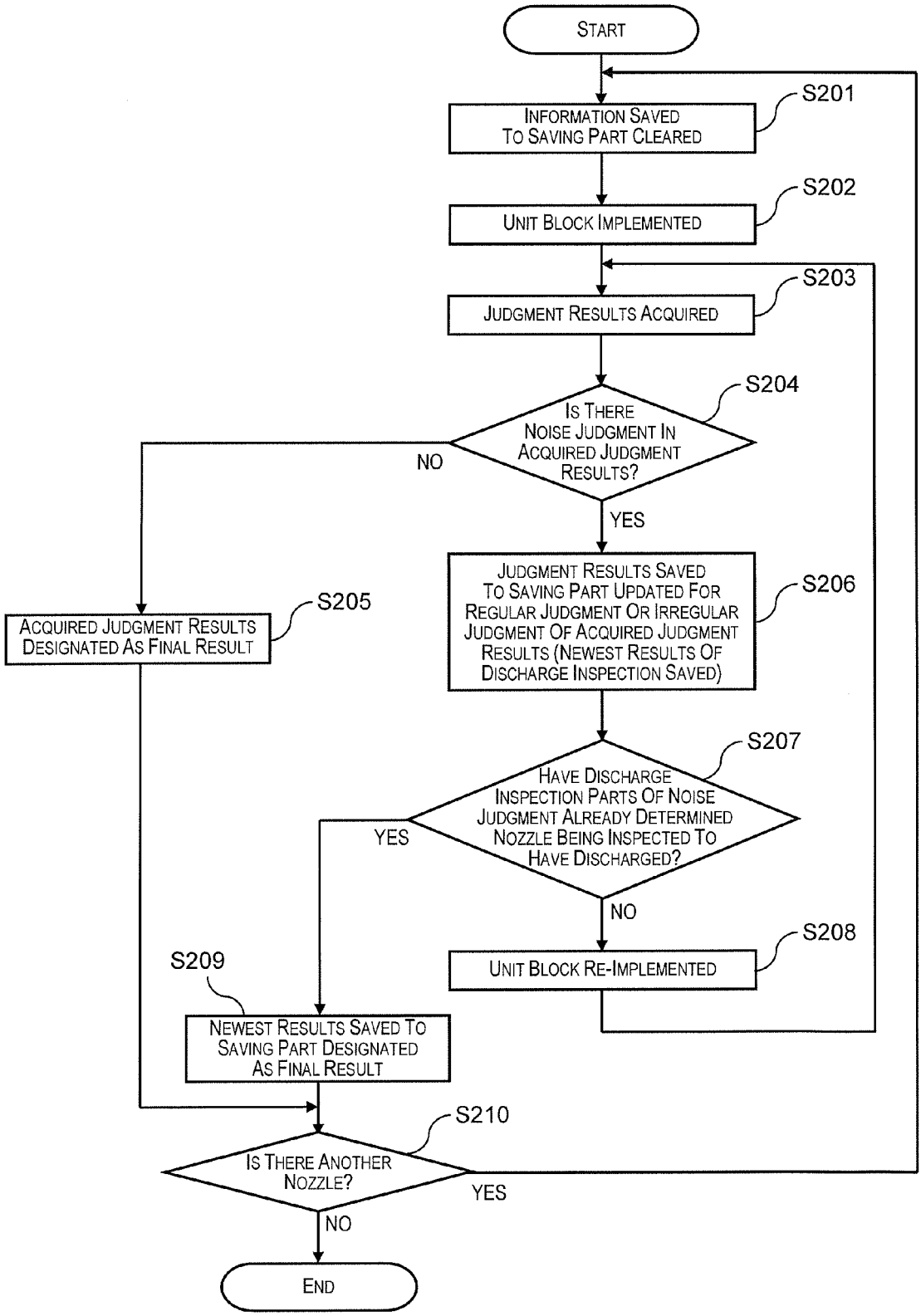
FIG. 16 is an explanatory chart of the flow of parallel processing by a controller 10.

FIG. 16 is an explanatory chart of the flow of parallel processing by a controller 10. The processes of FIG. 16 are achieved by the controller 10 controlling the other units according to programs stored in the memory 13. FIG. 17 is an explanatory chart of judgment results of nozzle #1 of a matte black nozzle row. FIG. 18 is an explanatory chart of judgment results saved to a saving part of the controller 10. In FIGS. 17 and 18, the circles indicate a "regular judgment," the x symbols indicate an "irregular judgment," and the ? symbols indicate a "noise judgment."

First, after clearing the information saved to the saving part (S201), the controller 10 implements the first unit block, and acquires the respective judgment results outputted from the four discharge inspection parts 60 (see FIG. 15) (S203). The judgment results of the first unit block are a "regular judgment" from the first, third, and fourth discharge inspection parts, and a "noise judgment" from the second discharge inspection part 60 (2).

Next, the controller 10 determines whether or not a noise judgment is included in the four acquired judgment results (S204). If a noise judgment is included (NO in S204), the controller 10 stored the acquired judgment results as the final result in the memory 13 and ends the discharge inspection of nozzle #1 (S205). Since a noise judgment is included in the four acquired judgment results (YES in S204), the controller 10 updates the judgment results saved to the saving part for the judgment results of the first, third, and fourth discharge inspection parts which have performed discharge inspection. The newest results of the discharge inspection (a regular judgment or an irregular judgment) are saved to the saving part by the process of S206.

After S206, the controller 10 determines whether or not the second discharge inspection part 60 (2), which has performed a noise judgment, has already judged the nozzle being inspected to have discharged (S207). This determination is performed based on whether or not the updated result of the discharge judgment of the second discharge inspection part 60 (2) saved to the saving part is a regular judgment or an irregular judgment. Since the result of S207 is NO for the process of the first unit block, the controller 10 re-implements the unit block (S208). (In the process of the first unit block, S207 is not necessary.) The judgment result of the second discharge inspection part 60 (2) continues to be a "noise judgment" ten times, as shown in FIG. 17. Therefore, the controller 10 determines YES in S204 and NO in S207 for each of the processes of the ten unit blocks.

The judgment result of the second discharge inspection part 60 (2) for the process of the eleventh unit block is a "regular judgment," and the controller 10 acquires the results of the discharge judgment of the discharge inspection part 60 for the first time. In the eleventh unit block process, however, the judgment result of the first discharge inspection part 60 (1) is a "noise judgment." Therefore, the controller 10 determines NO in S204 even for the eleventh unit block process. In the eleventh unit block process, the judgment results saved to the saving part are updated for the judgment results of the second through fourth discharge inspection parts by the process of S206. Since the "noise judgment" of the first discharge inspection part is not a discharge judgment (a regular judgment or an irregular judgment), this judgment result is not saved to the saving part. As a result, the newest results saved to the saving part at this stage are "regular judgment" for the first and second discharge inspection parts and "irregular judgment" for the third and fourth discharge inspection parts (see FIG. 18).

Next, in the process of S207, the controller 10 determines whether or not the first discharge inspection part 60 (1), which has performed a noise judgment, has already judged the nozzle being inspected to have discharged. This determination is performed based on whether or not the updated result of the first discharge inspection part 60 (1) saved to the saving part is a regular judgment or an irregular judgment. Since the updated result of the first discharge inspection part saved to the saving part is a "regular judgment" as shown in FIG. 18, the controller 10 determines YES in S207 in the eleventh unit block process.

When S207 is YES, the controller 10 stores the newest results of the discharge judgments (regular judgments or irregular judgments), which are saved to the saving part, in the memory 13 as the final result, and ends the discharge inspection of nozzle #1 (S209). As a result, discharge inspections are completed for the nozzles #1 of the matte black nozzle rows of the first head 41 (1), the fifth head 41 (5), the ninth head 41 (9), and the thirteenth head 41 (13), the respective results of which are a "regular judgment," a "regular judgment," an "irregular judgment," and an "irregular judgment."

The controller 10 then determines whether or not there is another nozzle to be inspected (S210). In this example, the controller 10 determines NO in S210 and next implements a unit block with nozzle #2 as the inspection target.

As described above, in the present embodiment, even when a noise judgment is included in the judgment result (YES in S204), if the discharge inspection part 60 that has issued the noise judgment has already performed a regular discharge judgment on the nozzle being inspected (YES in S207), the discharge inspection of that nozzle is completed (S209). It is thereby possible to suppress lengthening of the discharge inspections, regardless of a plurality of discharge inspections being performed in parallel.

In the present embodiment, since the discharge inspection is performed based on the newest results of the discharge judgments, a discharge inspection conforming to the current state of the device can be performed even if the nozzle's state of discharge changes during the inspection. The saving part of the controller 10 need only save the newest results and need not save preceding judgment results.

The controller 10 counts the total value of the number of unit block implementations until inspection of all the nozzles is complete. When the total value exceeds a predetermined number, the controller 10 makes notification of an error. It is thereby possible to avoid circumstances in which a unit block is continually repeated due to a noise judgment.

5. Modifications

Figure 19:
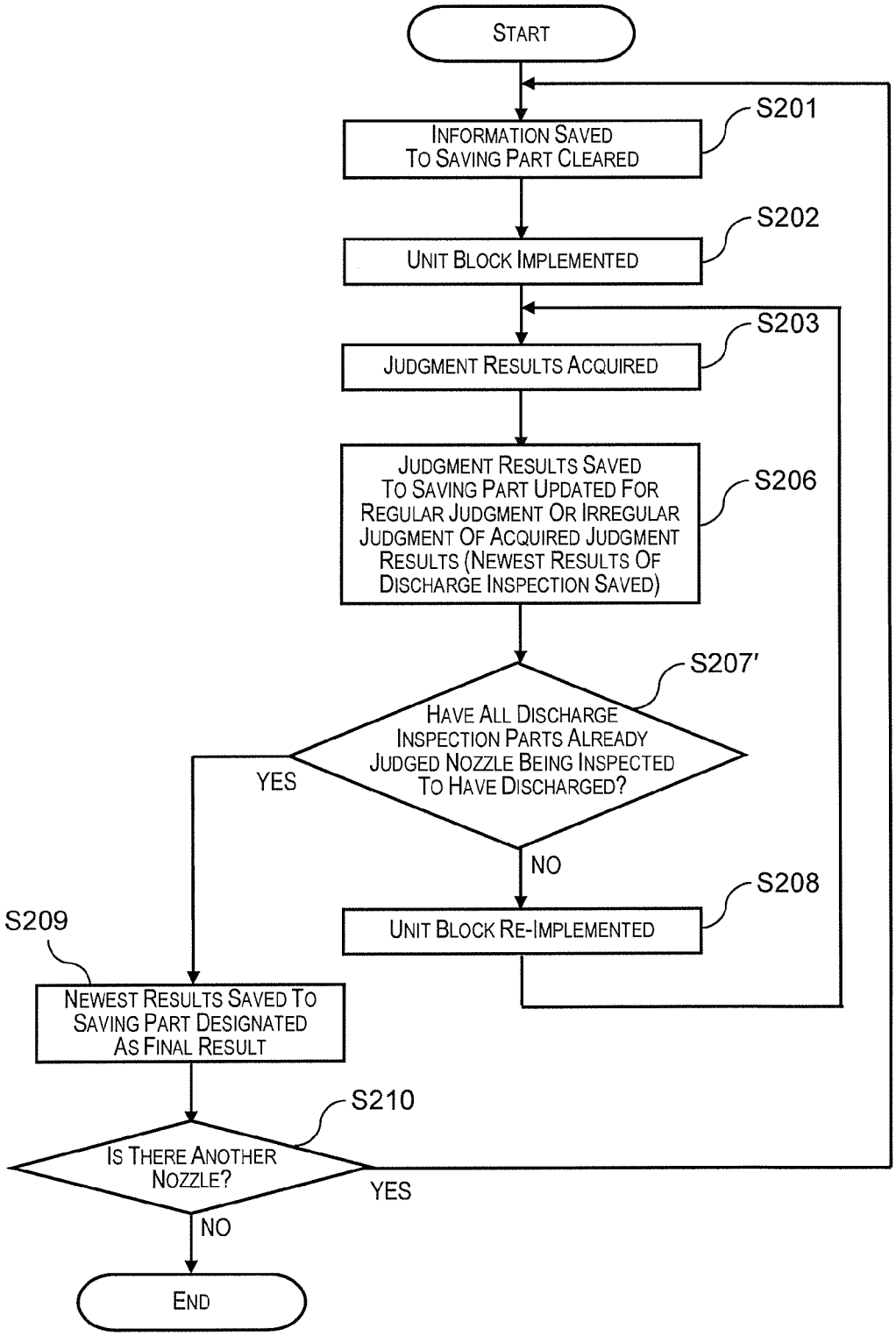
FIG. 19 shows a modification of the process flow of FIG. 16.

FIG. 19 shows a modification of the process flow of FIG. 16. The processes of FIG. 19 are achieved by the controller 10 controlling the other units according to programs stored in the memory 13. In the previously described FIG. 16, the determination process of S204 was performed before the processes of S206 and S207. As a result, there were two processes of storing the final result in the memory 13: the judgment results acquired from the discharge inspection parts being stored unchanged in the memory 13, and the judgment results saved to the saving part being stored in the memory 13. In the modification shown in FIG. 19, the process of S204 of FIG. 16 is omitted, and the processes of storing the final result in the memory 13 are consolidated.

In this modification, after acquiring judgment results outputted from the discharge inspection parts 60 (S203), the controller 10 updates the judgment results saved to the saving part for the discharge inspections (regular judgments or irregular judgments) of the acquired judgment results (S206). Since a "noise judgment" is not a discharge judgment (a regular judgment or an irregular judgment), this judgment result is not saved to the saving part. This process is the same as the process of S206 of FIG. 16.

After the process of S206, the controller 10 determines whether or not all of the discharge inspection parts have already judged the nozzle being inspected as having discharged (S207'). In the modification, since it is determined whether or not "all of the discharge inspection parts" have already judged the nozzle being inspected as having discharged, this determination, as shall be apparent, also includes the determination of whether or not "discharge inspection parts that have performed a noise judgment" have already judged the nozzle being inspected as having discharged. For example, during the eleventh unit block process of FIG. 17, it is also determined whether or not the first discharge inspection part 60 (1), which has performed a noise judgment, has already judged the nozzle being inspected as having discharged.

When S207 is NO, the controller 10 re-implements the unit block (S208). When S207 is YES, the controller 10 stores the newest result of the discharge judgment (a regular judgment or an irregular judgment), which is saved to the saving part, in the memory 13, and ends the discharge inspection of the nozzle being inspected (S209). The controller 10 then determines whether or not there is another nozzle to be inspected (S210).

As described above, in the modification, when a noise judgment is included in the judgment result, if the discharge inspection part 60 that has issued the noise judgment has already performed a regular discharge judgment on the nozzle being inspected (YES in S207'), the discharge inspection of that nozzle is completed (S209). It is thereby possible to suppress lengthening of the discharge inspections, regardless of a plurality of discharge inspections being performed in parallel.

Comparative Example

Figure 20:
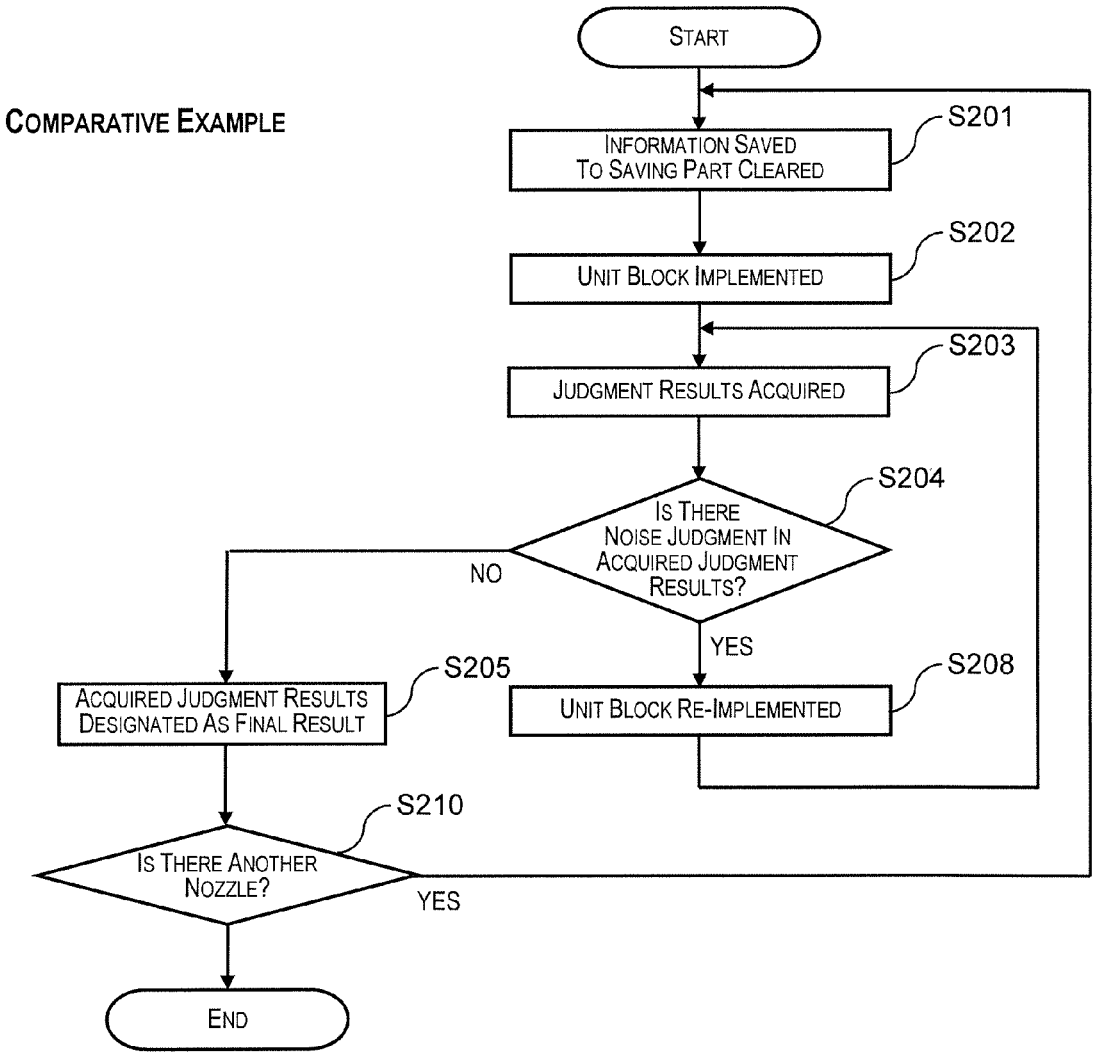
FIG. 20 is an explanatory chart of the flow of parallel processing of a comparative example.

FIG. 20 is an explanatory chart of the flow of parallel processing of a comparative example.

In comparison with FIG. 16 previously described, a difference here is that if there is a noise judgment, re-implementation of a unit block is performed immediately. With such parallel processing, it is time-consuming to complete the discharge inspections of all the nozzles. Particularly, as a greater number of discharge inspections are processed in parallel, there will be a higher probability that a plurality of judgment results will include a noise judgment, and the time required for discharge inspection will be extremely long. For example, if the judgment result of the eleventh unit block is as shown in FIG. 17, another unit block will be re-implemented after the eleventh unit block.

Therefore, if a discharge inspection part 60 that has issued a noise judgment has already performed a discharge judgment as regular on the nozzle being inspected (YES in S207 of FIG. 16), the discharge inspection of that nozzle is completed, and the inspection target is then preferably transferred to the next nozzle.

Other Embodiments

Unit Blocks

According to the embodiment previously described, there were two discharge inspection time periods at the start of the unit block, after which there was one noise inspection time period. However, the configuration of the unit block is not limited to this example.

Figure 21A:
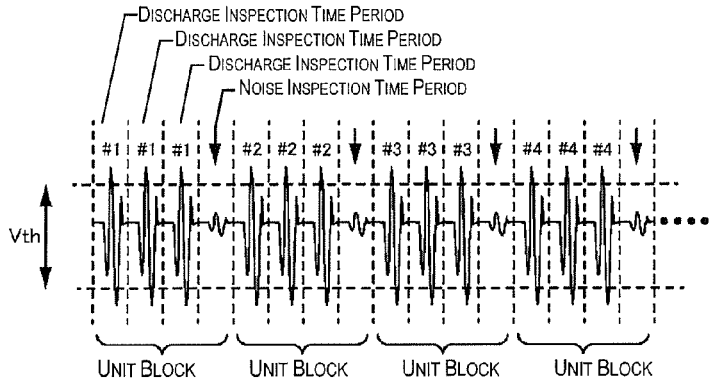
FIGS. 21A to 21D are explanatory charts of detection signals by other unit blocks.
Figure 21B:
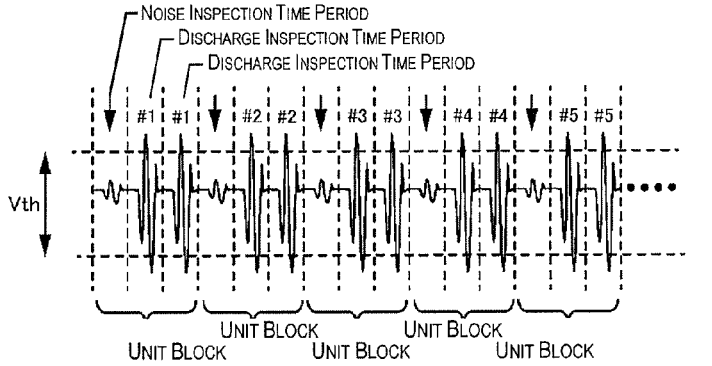

FIGS. 21A to 21D are explanatory charts of detection signals by other unit blocks. In FIG. 21A, the unit blocks are configured from an initial three discharge inspection time periods, and a subsequent single noise inspection time period. Thus, the discharge inspection time periods are not limited to two, and can be three or more. In FIG. 21B, the unit blocks are configured from an initial single noise inspection time period, and subsequent two discharge inspection time periods. Thus, the noise inspection time period can precede the discharge inspection time periods.

Though not shown in the charts, if a plurality of discharge inspection time periods are performed continuously in a unit block, a noise inspection time period can come between two discharge inspection time periods. If a plurality of discharge inspection time periods are performed continuously in a unit block, the length of the unit block can be shortened by placing the noise inspection time period either at the start or end of the unit block.

Figure 21C:
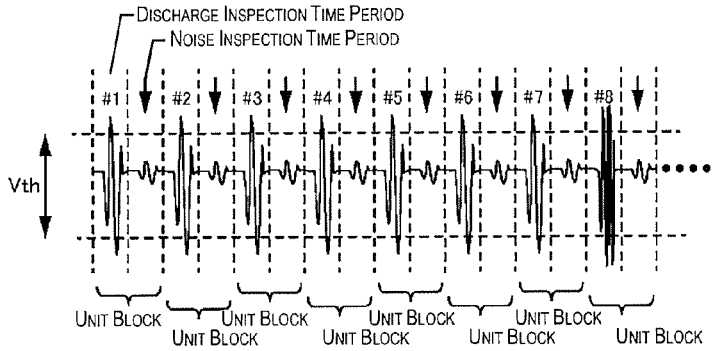
Figure 21D:
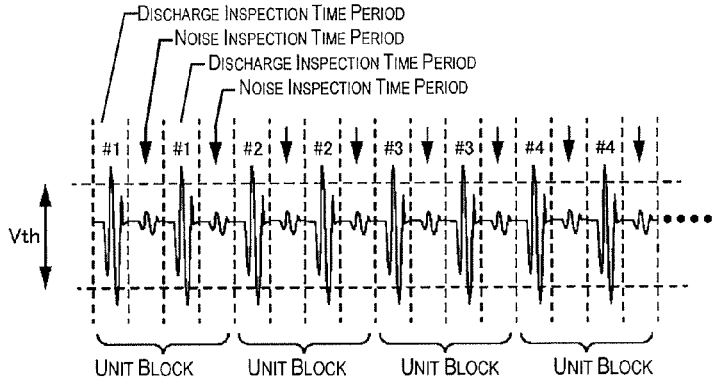

In FIG. 21C, there is only one discharge inspection time period in each unit block, and not a plurality of continuous discharge inspection time periods. Therefore, when spike noise occurs in the discharge inspection time period, there is a risk of erroneous inspection. For example, according to the detection signal in this chart, spike noise occurs during the discharge inspection time period of nozzle #8, and erroneous inspection occurs even though nozzle #8 is not discharging ink regularly because the amplitude Va of the detection signal exceeds the threshold Vth. In FIG. 21D, although there is a plurality of discharge inspection time periods in each unit block, they are not continuous. Therefore, the possibility of erroneous inspection is higher than when the discharge inspection time periods are continuous.

Even when a unit block such as the one described above is used, if a discharge inspection part 60 that has issued a noise judgment has already judged the nozzle being inspected to be discharging regularly (YES in S207), lengthening of the discharge inspections can be suppressed even when a plurality of discharge inspections are processed in parallel if a process is performed for completing the discharge inspections of that nozzle (S209).

<Parallel Processing>

Figure 22:
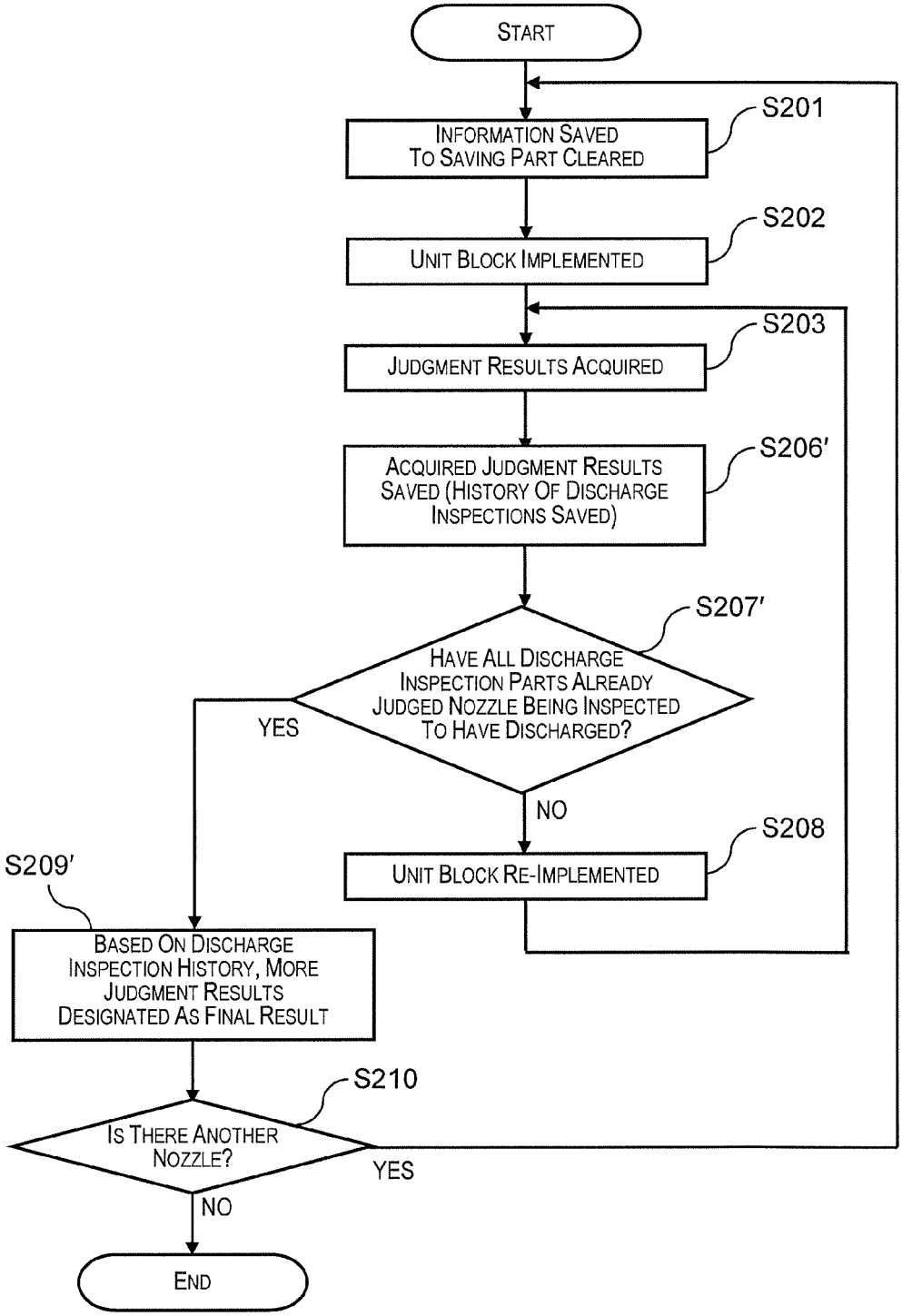
FIG. 22 is an explanatory chart of the flow of another parallel processing.

FIG. 22 is an explanatory chart of the flow of another parallel processing. FIG. 23 is an explanatory chart of judgment results by the process of FIG. 22. The processes of FIG. 22 are achieved by the controller 10 controlling the other units according to programs stored in the memory 13. Comparing FIG. 22 and the previously described FIG. 19, the difference is that the saving part does not save the newest results but instead saves all the judgment results acquired up to the newest results (S206'). Specifically, according to the process of S206', the saving part saves a history of the discharge judgments. Comparing FIG. 22 and the previously described FIG. 19, another difference is the method of determining the final result (S209'). According to the process of S209' of FIG. 22, more judgment results are designated as the final result on the basis of the history of discharge judgments (regular judgments or irregular judgments). For example, if the eleventh unit block judgment result is as shown in FIG. 23, the controller 10 determines a "regular judgment" for the nozzle being inspected of the fourth discharge inspection part because there are more regular judgments (six) than irregular judgments (five). The probability of the inspection result being correct thereby increases. In comparison with the previously described FIG. 19, the amount of information to be saved to the saving part is greater.

Figure 24:
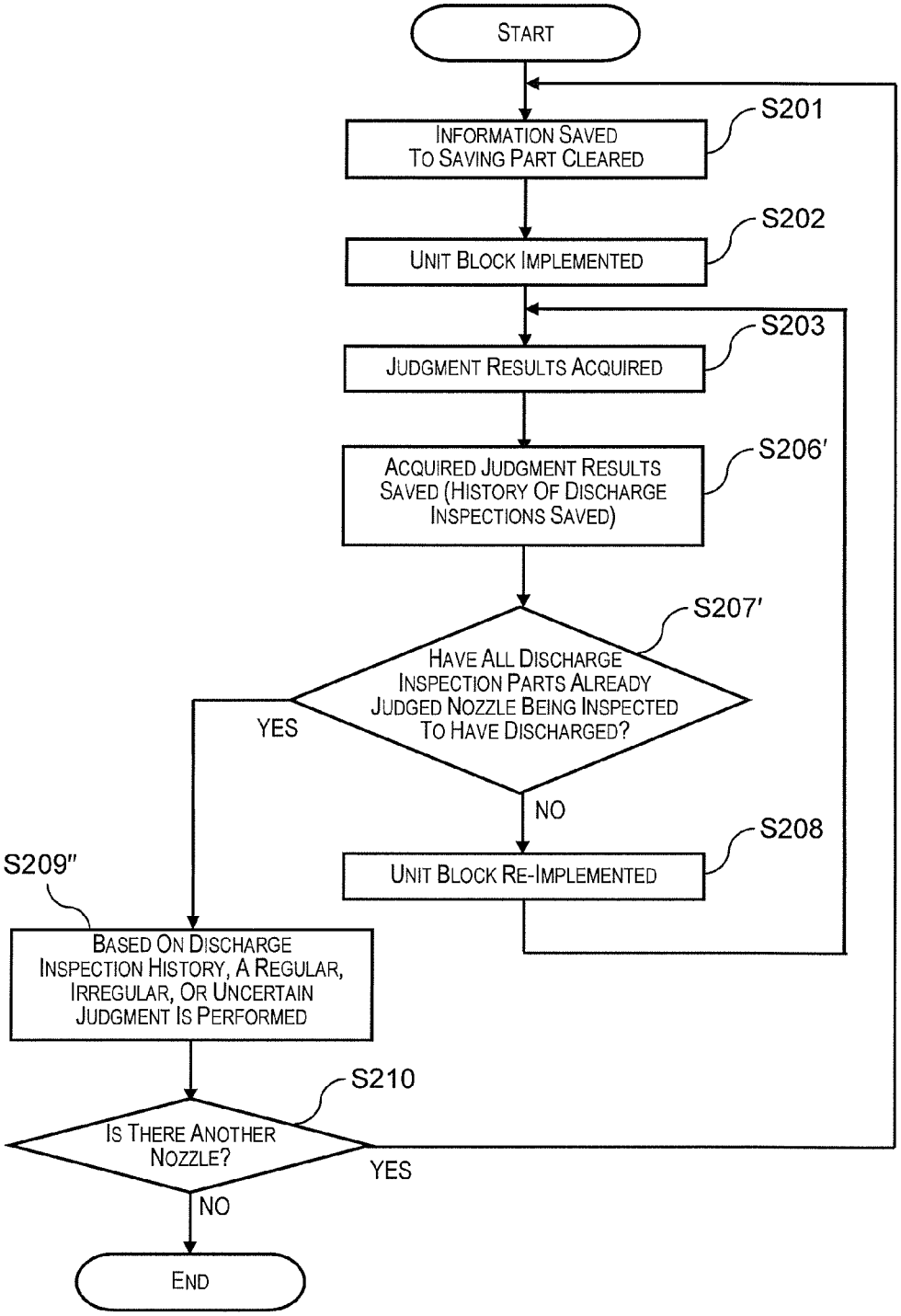
FIG. 24 is an explanatory chart of the flow of yet another parallel processing.

FIG. 24 is an explanatory chart of the flow of yet another parallel processing. FIG. 25 is an explanatory chart of judgment results by the processing of FIG. 24. The processes of FIG. 24 are achieved by the controller 10 controlling the other units according to programs stored in the memory 13. Comparing FIG. 24 with the previously described FIG. 22, the difference is the method of determining the final result (S209"). According to the process of S209" of FIG. 24, the percentage of regular judgments is calculated based on the history of discharge judgments (regular judgments or irregular judgments), and according to this percentage, one of three final results is issued: a regular judgment, an irregular judgment, or an uncertain judgment. Specifically, a new final result, the "uncertain judgment," has been added. Specifically, based on the discharge judgment history, the controller 10 issues a "regular judgment" if regular judgments are 60% or more of all the discharge judgments, an "uncertain judgment" if regular judgments are 40% or more but less than 60% of all the discharge judgments, and an "irregular judgment" if regular judgments are less than 40% of all the discharge judgments. For example, if the eleventh unit block judgment result is as shown in FIG. 25, the controller 10 determines an "uncertain judgment" for the nozzle being inspected of the fourth discharge inspection part. The controller 10 can, for example, change the head cleaning method in accordance with the final result. For example, if the result is an irregular judgment, the controller 10 can execute a cleaning method with a vacuum system which consumes a greater amount of ink, and if the result is an uncertain judgment, the controller 10 can execute a cleaning method with a flushing system (a system of discharging ink from the head in the printing area) which consumes a comparatively smaller amount of ink.

Even with the parallel processing described above, if a discharge inspection part 60 that has issued a noise judgment has already performed a discharge judgment as regular on the nozzle being inspected, the discharge inspection of that nozzle is completed and the inspection target is shifted to the next nozzle. It is therefore possible even with this parallel processing to lengthen the discharge inspection when a plurality of discharge inspections are processed in parallel.

<Electrodes>

In the embodiment previously described, the nozzle plate 41*a* (equivalent to the first electrode) has a ground electric potential, and the plate-shaped electrode 61 (equivalent to the second electrode) has a high electric potential. However, the invention is not limited to this example. In the embodiment previously described, electric potential changes in the high-electric-potential electrode are detected, but no limitation is provided by way of this example.

Figure 26A:
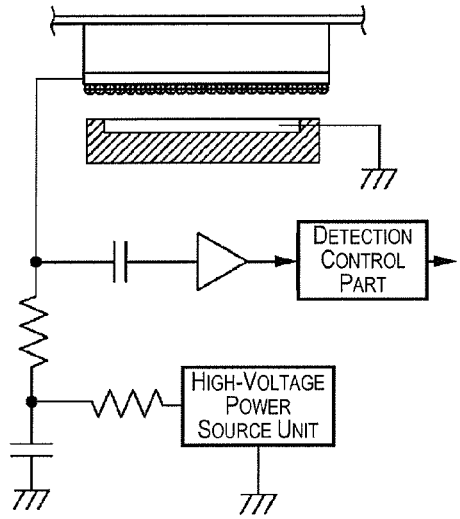
FIGS. 26A to 26C are explanatory drawings of other configurations of the discharge inspection parts.
Figure 26B:
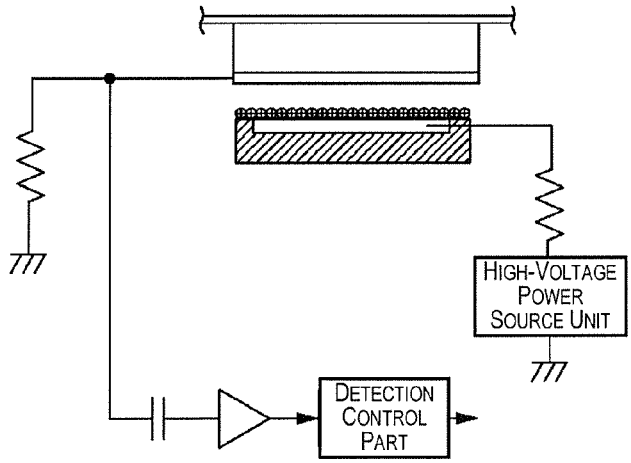
Figure 26C:
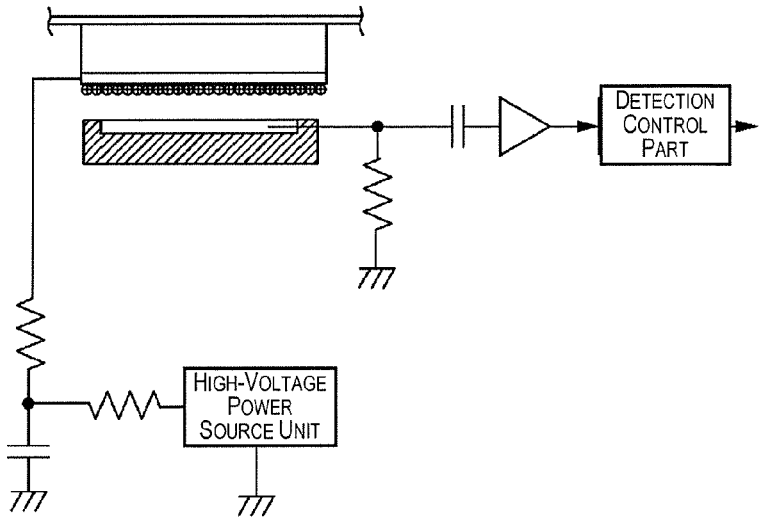

FIGS. 26A to 26C are explanatory drawings of other configurations of the discharge inspection parts. In FIG. 26A, electric potential changes in the high-electric-potential electrode are detected as in the embodiment previously described. However, unlike the embodiment previously described, the nozzle plate has a high electric potential, and the cap side electrode has a ground electric potential. In FIG. 26B, as in the embodiment previously described, the nozzle plate has a ground electric potential, and the cap side electrode has a high electric potential. However, unlike the embodiment previously described, electric potential changes in the nozzle plate are detected. In FIG. 26C, as in the embodiment previously described, electric potential changes in a detection electrode 22 are detected. However, unlike the embodiment previously described, the nozzle plate has a high electric potential, and the cap side electrode has a ground electric potential. Even with such a configuration of discharge inspection parts, nearly the same discharge inspection as the embodiment previously described can be performed.

Other

The embodiment previously described primarily deals with printers, but also of course includes the disclosure of liquid-discharging devices, inspection methods of liquid-discharging devices, programs, storage mediums that store programs, and the like.

The embodiment described above is intended to make the invention easier to understand and should not be interpreted as limiting the invention. The invention can be modified and improved without deviating from the scope thereof, and the invention includes equivalents thereof, as shall be apparent. The embodiment described hereinbelow in particular is included in the invention.

<Printer>

A printer is described in the embodiment described above, but the invention is not limited to this example. For example, the same techniques of the present embodiment can be applied to various other liquid-discharging devices that use the inkjet technology, such as color filter manufacturing devices, dye devices, micromachining devices, semiconductor manufacturing devices, surface machining devices, three-dimensional modeling devices, gasifying and vaporizing devices, organic EL manufacturing devices (particularly macromolecular EL manufacturing devices), display manufacturing devices, film-forming devices, and DNA chip manufacturing devices.

Ink

The embodiment previously described was an embodiment of a printer, and dye ink or pigment ink was therefore discharged from the nozzles. However, the liquid discharged from the nozzles is not limited to such ink. For example, the nozzles can discharge liquids (including water) which include metal materials, organic materials (particularly macromolecular materials), magnetic materials, electroconductive materials, wiring materials, film-forming materials, electronic ink, machining liquids, gene solutions, and the like.

Nozzles

In the embodiment previously described, ink was discharged using piezoelectric elements. However, the system for discharging liquid is not limited to this example. Other systems can also be used, such as a system for creating bubbles in the nozzles by heat, for example.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid-discharge inspection device for a liquid-discharging device, comprising:

a first head having first and second nozzles being configured to discharge liquid;

a second head having third and fourth nozzles being configured to discharge the liquid;

a first discharge inspection part being configured to inspect and judge a first target nozzle regarding whether or not the first target nozzle discharges the liquid, and being configured to again inspect the first target nozzle if noise is detected during the first target nozzle being inspected, the first target nozzle shifting among the first nozzle and the second nozzle; and a second discharge inspection part being configured to inspect and judge a second target nozzle regarding whether or not the second target nozzle discharges the liquid, and being configured to again inspect the second target nozzle if noise is detected during the second target nozzle being inspected, the second target nozzle shifting among the third nozzle and the fourth nozzle;

the first target nozzle and the second target nozzle shifting in parallel, the first discharge inspection part and the second discharge inspection part inspecting the first target nozzle and the second target nozzle in parallel, and wherein the first target nozzle and the second target nozzle shift, if the first target nozzle has been judged, regardless of or not the noise is detected during the first target nozzle being again inspected.

2. The liquid-discharging device according to claim 1, wherein the first discharge inspection part is configured to judge the first nozzle based on the most recent result of whether or not the first nozzle discharges the liquid.

3. The liquid-discharging device according to claim 1, wherein a result of judging whether or not the first nozzle discharges the liquid is stored in a history, and the first discharge inspection part is configured to inspect and judge the first nozzle and the second nozzle based on the history.

4. The liquid-discharging device according to claim 3, wherein the first discharge inspection part is configured to judge the first nozzle based on a number of times for which the first nozzle properly discharges the liquid and a number of times for which the first nozzle properly discharges the liquid in the history.

5. The liquid-discharging device according to claim 3, wherein the first discharge inspection part is configured to judge the first nozzle based on a percentage of the first nozzle properly discharging the liquid over a total number of the results based on the history.

6. The liquid-discharging device according to claim 1, wherein if the number of times for which the first nozzle is inspected exceeds more than a predetermined number, a notification of an error is issued.

7. A method for inspecting a liquid-discharging device including a first head having first and second nozzles being configured to discharge liquid and a second head having third and fourth nozzles being configured to discharge the liquid, the method comprising:

inspecting and judging a first target nozzle regarding whether or not the first target nozzle discharges the liquid;

inspecting again the first target nozzle if noise is detected during the first target nozzle being inspected, shifting among the first nozzle and the second nozzle;

inspecting and judging a second target nozzle regarding whether or not the second target nozzle discharges the liquid;

inspecting again the second target nozzle if noise is detected during the second target nozzle being inspected;

shifting among the third nozzle and the fourth nozzle;

the first target nozzle and the second target nozzle shifting in parallel, inspecting the first target nozzle and the second target nozzle in parallel; and shifting the first target nozzle and the second target nozzle, if the first target nozzle has been judged, regardless of or not the noise is detected during the first target nozzle being again inspected.

8. A non-transitory computer readable medium storing a computer program for inspecting a liquid-discharging device including a first head having first and second nozzles being configured to discharge liquid and a second head having third and fourth nozzles being configured to discharge the liquid, the computer program comprising:

code inspecting and judging a first target nozzle regarding whether or not the first target nozzle discharges the liquid;

code for inspecting again the first target nozzle if noise is detected during the first target nozzle being inspected, code for shifting among the first nozzle and the second nozzle;

code for inspecting and judging a second target nozzle regarding whether or not the second target nozzle discharges the liquid;

code for inspecting again the second target nozzle if noise is detected during the second target nozzle being inspected;

code for shifting among the third nozzle and the fourth nozzle;

code for shifting the first target nozzle and the second target nozzle in parallel, code for inspecting the first target nozzle and the second target nozzle in parallel; and code for shifting the first target nozzle and the second target nozzle, if the first target nozzle has been judged, regardless of or not the noise is detected during the first target nozzle being again inspected.

* * * * *